US008294595B1

(12) United States Patent
Plotke et al.

(10) Patent No.: US 8,294,595 B1
(45) Date of Patent: Oct. 23, 2012

(54) SPEED DETECTOR FOR MOVING VEHICLES

(75) Inventors: Leonard Alan Plotke, Los Angeles, CA (US); Subhash Chandra Hegde, Moorpark, CA (US); Christopher A. Mouton, Los Angeles, CA (US)

(73) Assignee: The Boeing Company, Chicago, IL (US)

( * ) Notice: Subject to any disclaimer, the term of this patent is extended or adjusted under 35 U.S.C. 154(b) by 445 days.

(21) Appl. No.: 12/563,414

(22) Filed: Sep. 21, 2009

(51) Int. Cl.
*G08G 1/017* (2006.01)

(52) U.S. Cl. ..... 340/937; 340/441; 340/973

(58) Field of Classification Search ..... 340/937, 340/936, 953, 969, 978, 441, 438, 466, 905, 340/929, 951, 973
See application file for complete search history.

(56) References Cited

U.S. PATENT DOCUMENTS 4,253,670 A * 3/1981 Moulton et al. ..... 273/348.1
4,866,438 A * 9/1989 Knisch ..... 340/936
5,734,337 A * 3/1998 Kupersmit ..... 340/937
6,205,231 B1 3/2001 Isadore-Barreca et al.
2001/0011957 A1* 8/2001 Mitchell et al. ..... 340/936
2005/0119030 A1* 6/2005 Bauchot et al. ..... 455/564
2006/0055521 A1* 3/2006 Blanco et al. ..... 340/441
2010/0172543 A1* 7/2010 Winkler ..... 382/104

OTHER PUBLICATIONS

U.S. Appl. No. 12/880,370, filed Sep. 13, 2010, Plotke.
Plotke, "Beam-Scanning System," U.S. Appl. No. 13/011,354, filed Jan. 21, 2011, 45 pages.
Plotke, "Audio Surveillance System," U.S. Appl. No. 13/036,142, filed Feb. 28, 2011, 61 pages.

* cited by examiner

*Primary Examiner* — Daniel Previl
(74) *Attorney, Agent, or Firm* — Yee & Associates, P.C.

(57) ABSTRACT

A method and apparatus for detecting moving vehicles. A determination is made as to whether a number of vehicles are present in a video data stream received from a camera system. In response to the number of vehicles being present, a number of speed measurements for each vehicle in the number of vehicles are obtained from a radar system. A determination is made as to whether a speed of a set of vehicles in the number of vehicles exceeds a threshold. In response to a determination that the speed of the set of vehicles exceeds the threshold, a report is created for the set of the vehicles exceeding the threshold.

25 Claims, 15 Drawing Sheets

SPEED DETECTOR FOR MOVING VEHICLES

BACKGROUND INFORMATION

1. Field:

The present disclosure relates generally to detecting the speed of objects and, in particular, to detecting the speed of moving vehicles. Still more particularly, the present disclosure relates to a method and apparatus for detecting the speed of multiple vehicles simultaneously.

2. Background:

Vehicles moving faster than the posted speed limits on highways and other roads may disrupt the flow of traffic and may result in accidents. Law enforcement officers, such as local police officers and state highway patrol officers, patrol highways in an effort to reduce the number of vehicles that exceed the speed limits. When a vehicle exceeding a speed limit on a roadway is identified, the vehicle may be stopped. In most instances, a citation is issued to the driver of the vehicle for exceeding the speed limit. These actions help increase compliance with speed limits on different roadways.

With these law enforcement efforts, only a small percentage of vehicles are identified and stopped for speeding violations, as compared to other vehicles that are not detected or not stopped. This situation occurs because of a lack of resources to provide sufficient patrols of law enforcement officers to monitor for vehicles travelling faster than the speed limits.

Further, the process of detecting, stopping, and issuing citations requires time and expense. When a law enforcement officer is monitoring for speeders, the law enforcement officer is unable to perform other duties. As a result, other law enforcement officers may be needed. Further, a cost is involved in employing law enforcement officers to perform traffic control duties. In many cases, the ratio of ticket revenue to the cost of having a law enforcement officer patrol roadways is often lower than desired.

Therefore, it would be advantageous to have a method and apparatus that takes into account one or more of the issues discussed above, as well as possibly other issues.

SUMMARY

In one advantageous embodiment, a method is present for detecting moving vehicles. A determination is made as to whether a number of vehicles are present in a video data stream received from a camera system. In response to the number of vehicles being present, a number of speed measurements for each vehicle in the number of vehicles are obtained from a radar system. A determination is made as to whether a speed of a set of vehicles in the number of vehicles exceeds a threshold. In response to a determination that the speed of the set of vehicles exceeds the threshold, a report is created for the set of vehicles exceeding the threshold.

In another advantageous embodiment, a method is present for identifying vehicles exceeding a speed limit. Infrared frames are received from an infrared camera. A determination is made as to whether a number of vehicles are present in the infrared frames. In response to the number of vehicles being present in the infrared frames, a first number of speed measurements for each vehicle in the number of vehicles are obtained from a radar system, and a second number of speed measurements for each vehicle in the number of vehicles are generated using the infrared frames. A determination is made as to whether a speed of a set of vehicles in the number of vehicles exceeds a threshold using the first number of speed measurements and the second number of speed measurements. In response to a determination that the speed of the set of vehicles in the number of vehicles exceeds the threshold, a report is created for the set of vehicles exceeding the threshold.

In yet another advantageous embodiment, an apparatus comprises a camera system, a radar system, and a processor unit. The processor unit is configured to determine whether a number of vehicles are present in a video data stream received from the camera system. The processor unit is configured to obtain a number of speed measurements for each vehicle in the number of vehicles from the radar system in response to the number of vehicles being present. The processor unit is configured to determine whether a speed of a set of vehicles in the number of vehicles exceeds a threshold. The processor unit is configured to create a report for the set of vehicles exceeding the threshold in response to a determination that the speed of the set of vehicles in the number of vehicles exceeds the threshold.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives, and advantages thereof, will best be understood by reference to the following detailed description of an advantageous embodiment of the present disclosure when read in conjunction with the accompanying drawings, wherein:

DETAILED DESCRIPTION

Figure 1:
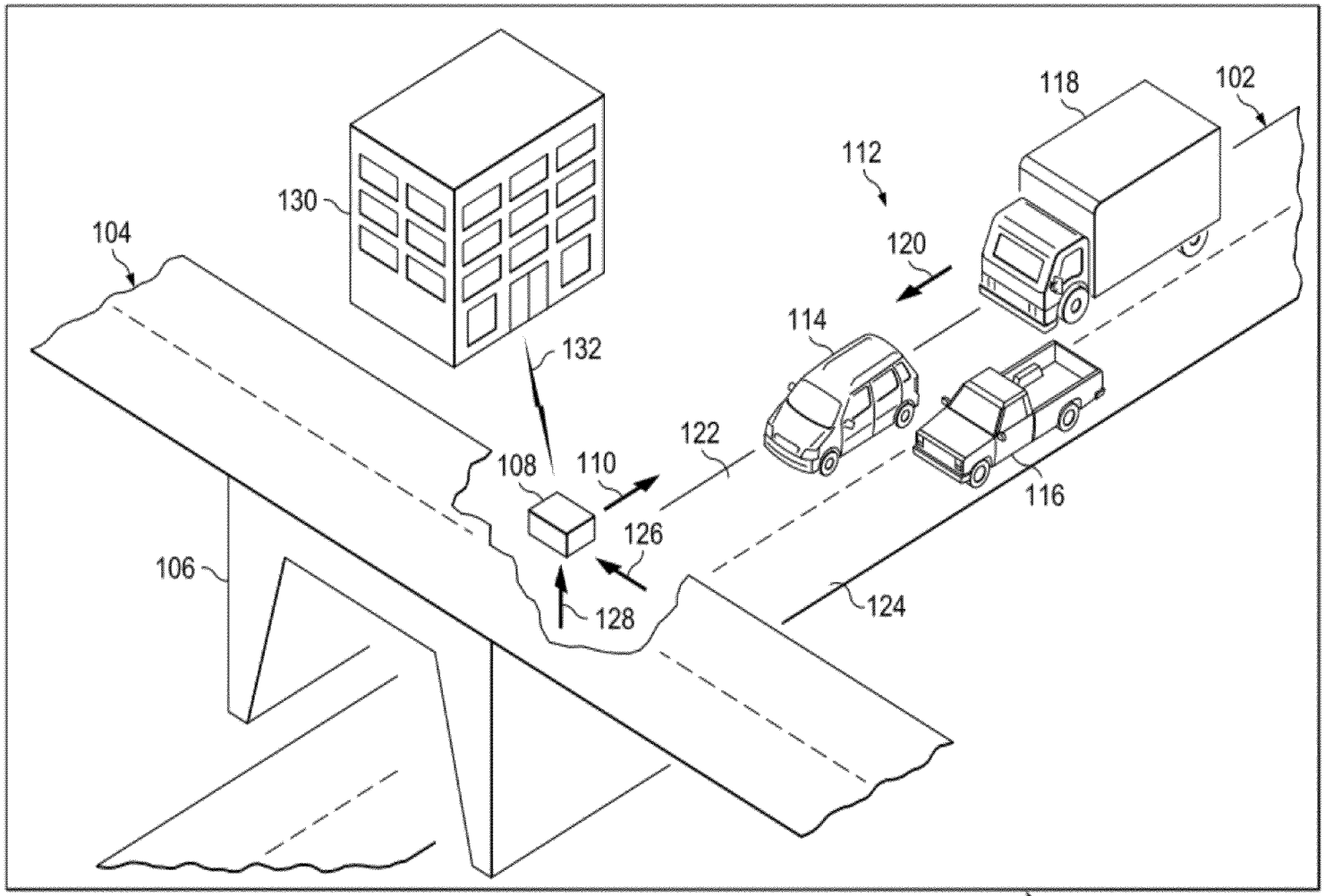
FIG. 1 is an illustration of a speed detection environment in accordance with an advantageous embodiment.

The different advantageous embodiments recognize and take into account a number of different considerations. For example, the different advantageous embodiments recognize that handheld and fixed position radar laser detectors are currently used to detect vehicles exceeding a speed limit but may not be as efficient as desired. A law enforcement officer may find it difficult to target a single moving vehicle on a busy highway. As a result, identifying and stopping the vehicle to provide the appropriate evidence needed to substantiate a speeding violation may be made more difficult.

Further, the different advantageous embodiments also recognize and take into account that a single law enforcement officer may only be able to detect and stop a single speeding vehicle. As a result, speeding vehicles may be stopped only one at a time when multiple vehicles may be found speeding on the same road.

The different advantageous embodiments also recognize that in some cases, multiple law enforcement officers may work together to increase the number of vehicles that can be stopped when speeding violations are identified. Even with this type of cooperation, a smaller percentage of speeding vehicles are identified, stopped, and given citations than desired for the costs. In other words, the ratio of revenue from tickets issued for violations to the cost for the law enforcement officers is lower than desired.

The different advantageous embodiments also recognize and take into account that a camera system may be used to detect the speed of a vehicle within a particular lane of traffic. These types of systems, however, are designed to identify one vehicle at a time in a particular lane. As a result, multiple camera systems of this type are required to cover multiple lanes. This use of additional camera systems increases the cost and maintenance needed to identify speeding vehicles and send citations to the owners of those vehicles.

In recognizing and taking into account these and other considerations, the different advantageous embodiments provide a method and apparatus for detecting moving vehicles. In a number of advantageous embodiments, a determination is made as to whether a number of vehicles are present in a video data stream received from a camera system. In response to the number of vehicles being present, speed measurements are obtained for each of the vehicles from a radar system. A determination is made as to whether a speed of a set of vehicles in a number of vehicles exceeds a threshold. In response to a determination that the speed of the set of vehicles exceeds a threshold, a report is created for the set of vehicles exceeding the threshold.

In a number of the different advantageous embodiments, the method and apparatus for detecting moving vehicles is capable of detecting multiple vehicles that may be present on the road. Further, the different advantageous embodiments also are capable of providing a desired level of accuracy. For example, in a number of the different advantageous embodiments, speed measurements may be made from two sources, such as the camera system and the radar system. Further, the different advantageous embodiments may set a threshold that increases the accuracy of a measurement. Further, with the increased accuracy, any citations or tickets issued for drivers of the vehicles may be more likely to withstand a challenge.

Turning now to FIG. 1, an illustration of a speed detection environment is depicted in accordance with an advantageous embodiment. In this example, speed detection environment 100 is an example in which a number of advantageous embodiments may be implemented. A number, as used herein with reference to items, means one or more items. For example, a number of advantageous embodiments is one or more advantageous embodiments.

In this example, speed detection environment 100 includes road 102 and road 104. Road 104 passes over road 102 at overpass 106 for road 104. In this illustrative example, speed detection system 108 is mounted on overpass 106. Speed detection system 108 has a line of sight as indicated by arrow 110.

In this illustrative example, oncoming traffic 112 includes vehicle 114, vehicle 116, and vehicle 118. In this illustrative example, vehicles 114, 116, and 118 are travelling in the direction of arrow 120. This direction of travel is towards speed detection system 108. As illustrated, vehicle 114 and vehicle 118 are travelling in lane 122, while vehicle 116 is travelling in lane 124 of road 102.

In these depicted examples, speed detection system 108 is configured to detect, track, and/or measure the speed of vehicles, such as vehicles 114, 116, and 118. More specifically, speed detection system 108 is configured to detect vehicles 114, 116, and 118 in different lanes. In other words, speed detection system 108 is configured to detect multiple vehicles in more than one lane.

Vehicle detection system 108 is configured to determine whether any of vehicles 114, 116, and 118 in oncoming traffic 112 are exceeding a speed limit. Speed detection system 108 is configured to detect and track multiple vehicles.

Speed detection system 108 sends a report to remote location 130 using wireless communications link 132 in these examples. Remote location 130 may be, for example, without limitation, a law enforcement agency, a third party contractor, a transportation authority, or some other suitable location.

In addition, speed detection system 108 may be configured to record speeds of oncoming traffic 112. From this speed information, speed detection system 108 may identify an average speed of traffic over different periods of time. This information may be transmitted to remote location 130. This type of information may be transmitted in addition to or in place of reports identifying vehicles that are exceeding the speed limit on road 102.

In this illustrative example, speed detection system 108 is offset horizontally in the direction of arrow 126 and vertically in the direction of arrow 128 with respect to oncoming traffic 112 on road 102. In these examples, speed detection system 108 is mounted in the direction of arrow 128 above road 102 and in the direction of arrow 126 on overpass 106 from road 102.

The illustration of speed detection environment 100 in FIG. 1 is not meant to imply physical or architectural limitations to the manner in which different advantageous embodiments may be implemented. Other components in addition to and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

For example, in some advantageous embodiments, a number of speed detection systems, in addition to speed detection system 108, may be present in speed detection environment 100. Further, in some advantageous embodiments, speed detection system 108 may be mounted on a pole, a stationary platform, a mobile platform, or some other suitable platform instead of on overpass 106.

As another example, in other advantageous embodiments, speed detection system 108 may detect traffic moving in both directions. In other words, if road 102 contains lanes for traffic moving in both directions, speed detection system 108 may be configured to identify vehicles that may be speeding for both oncoming traffic 112 and traffic moving away from speed detection system 108.

Figure 2:
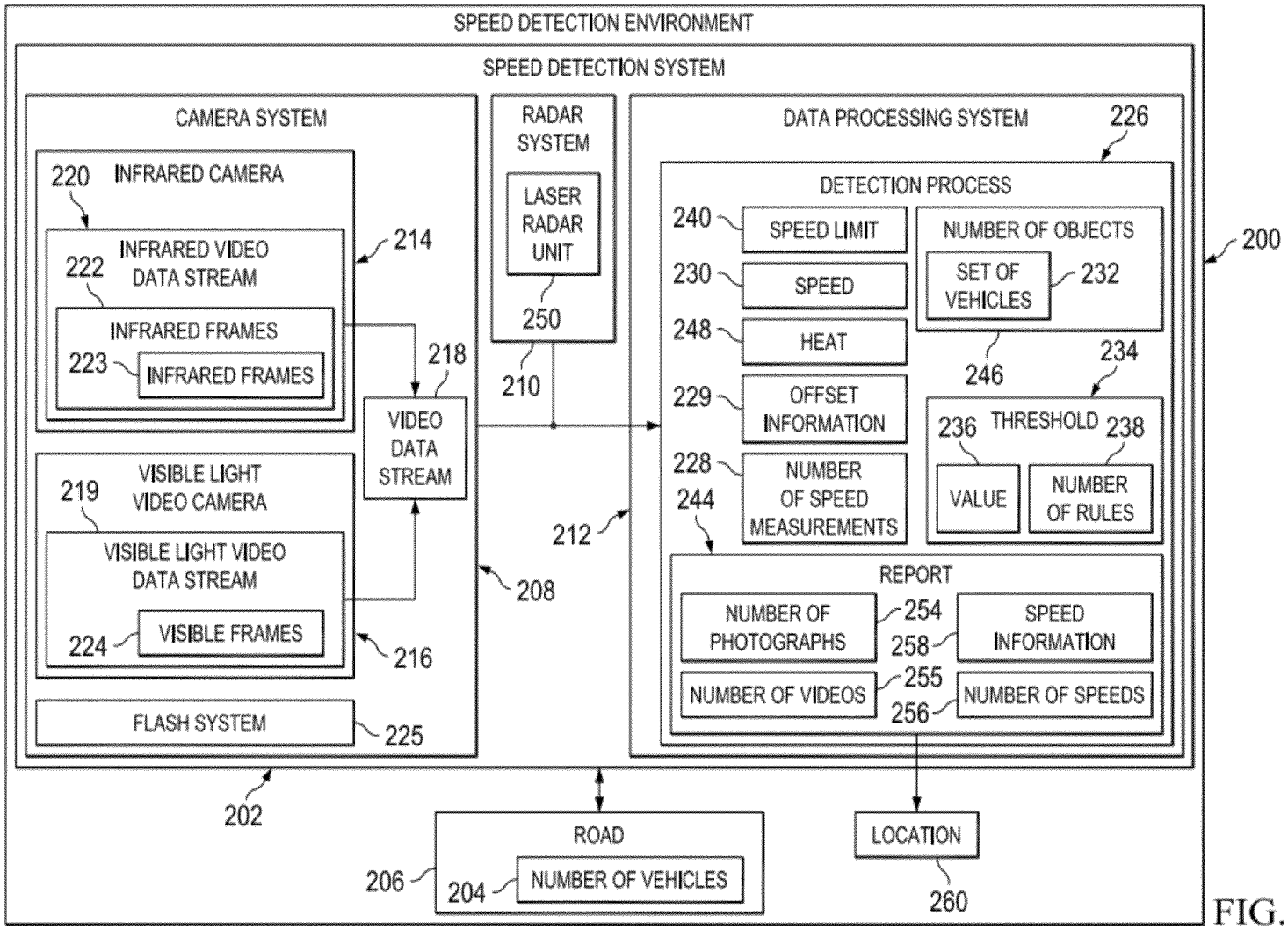
FIG. 2 is an illustration of a block diagram of a speed detection environment in accordance with an advantageous embodiment.

With reference now to FIG. 2, an illustration of a block diagram of a speed detection environment is depicted in accordance with an advantageous embodiment. Speed detection environment 200 is an example of one implementation for speed detection environment 100 in FIG. 1.

As illustrated, speed detection environment 200 uses speed detection system 202 to detect number of vehicles 204 on road 206 in speed detection environment 200. In this illustrative example, speed detection environment 200 includes camera system 208, radar system 210, and data processing system 212.

In this illustrative example, camera system 208 includes infrared camera 214 and visible light video camera 216. Infrared camera 214 may be implemented using any camera or sensor system that is sensitive to infrared light. Infrared light is electromagnetic radiation with a wavelength that is longer than that of visible light. Visible light video camera 216 may be implemented using any camera or sensor that is capable of detecting visible light. Visible light has a wavelength of about 400 nanometers to about 700 nanometers.

As depicted, infrared camera 214 and visible light video camera 216 generate information that form video data stream 218. In particular, video data stream 218 includes infrared video data stream 220 generated by infrared camera 214 and visible light video data stream 219 generated by visible light video camera 216. In these depicted examples, infrared video data stream 220 includes infrared frames 222, and visible light video data stream 219 includes visible frames 224. In some advantageous embodiments, infrared video data stream 220 and visible light video data stream 219 may include other types of information in addition to infrared frames 222 and visible frames 224, respectively.

A frame is an image. The image is formed from digital data and is made up of pixels in these illustrative examples. Multiple frames make up the data in video data stream 218. These frames may be presented as a video. These frames also may be used to form photographs or images for other uses than presenting video.

In some advantageous embodiments, infrared frames 222 and visible frames 224 are generated at a frequency of about 30 Hertz or about 30 frames per second. In other advantageous embodiments, infrared frames 222 and/or visible frames 224 may be generated at some other suitable frequency such as, for example, without limitation, 24 Hertz, 40 Hertz, or 60 Hertz. Further, infrared frames 222 and visible frames 224 may be either synchronous or asynchronous in these examples.

In these examples, infrared frames 222 and visible frames 224 may be analyzed to identify objects and track objects. In addition, these frames also may be analyzed to identify a speed of an object.

Although a single video data stream is depicted in these examples, in some advantageous embodiments, video data stream 218 may take the form of multiple video data streams in which each video data stream includes information generated by a different camera.

Additionally, camera system 208 also may include flash system 225. Flash system 225 generates light for visible light video camera 216 if light conditions are too low to obtain a desired quality for an image in video data stream 218.

In these depicted examples, visible light video data stream 219 may terminate when a condition for visible light video camera 216 has been met. This condition may be, for example, the occurrence of an event, the turning off of power for visible light video camera 216, a period of time, and/or some other suitable condition.

In this illustrative example, speed detection system 202 determines whether number of vehicles 204 is present on road 206 using video data stream 218 received from camera system 208. In these examples, the processing of video data stream 218 is performed by detection process 226 running on data processing system 212. In these examples, detection process 226 takes the form of a computer program executed by data processing system 212.

The identification of an object within number of objects 246 as a vehicle within number of vehicles 204 may be made in a number of different ways. For example, a particular value for heat 248 may indicate that an object within number of objects 246 is a vehicle. As another example, a direction of movement of an object within number of objects 246 also may indicate that the object is a vehicle in number of vehicles 204.

In these illustrative examples, infrared frames 222 and/or visible frames 224 may be used to generate measurements for number of speed measurements 228. The movement of objects between frames may provide data to generate number of speed measurements 228. Additionally, number of speed measurements 228 also includes information from radar system 210.

In response to number of vehicles 204 being present, number of speed measurements 228 is obtained by data processing system 212 for processing by detection process 226. Number of speed measurements 228 may be obtained from at least one of camera system 208 and radar system 210.

As used herein, the phrase "at least one of", when used with a list of items, means that different combinations of one or more of the listed items may be used and only one of each item in the list may be needed. For example, "at least one of item A, item B, and item C" may include, for example, without limitation, item A or item A and item B. This example also may include item A, item B, and item C, or item B and item C.

In some advantageous embodiments, detection process 226 also may have or receive offset information 229 from radar system 210. Offset information 229 is used to correct speed measurements within number of speed measurements 228 generated by radar system 210. In these illustrative examples, offset information 229 may include, for example, an angle of elevation with respect to road 206, an angle of azimuth with respect to road 206, a distance to a vehicle on road 206, and/or other suitable information.

In these illustrative examples, detection process 226 sends a command to radar system 210 based on offset information 229. For example, radar system 210 may be commanded to direct radar system 210 towards a vehicle on road 206 based on offset information 229 for the vehicle.

Detection process 226 determines whether speed 230 for set of vehicles 232 exceeds threshold 234. The use of the term "set" with reference to an item refers to one or more items. For example, set of vehicles 232 is one or more vehicles.

Threshold 234 may take various forms. For example, threshold 234 may be value 236 and number of rules 238. If threshold 234 is a value, the value is compared to speed 230. If speed 230 is greater than value 236 for a particular vehicle within number of vehicles 204, then the vehicle is part of set of vehicles 232 in this example.

In some advantageous embodiments, value 236 may be selected as, for example, without limitation, one mile per hour over the speed limit. In other advantageous embodiments, value 236 may be set as a percentage over the speed limit.

In yet other advantageous embodiments, number of rules 238 may specify that some portion of number of speed measurements 228 must have speed 230 greater than value 236. As one illustrative example, number of rules 238 may state that 95 out of 100 speed measurements must indicate that speed 230 is greater than value 236.

The number of measurements made and the number of measurements specified as being greater than the speed limit may vary, depending on the particular implementation. As the number of speed measurements in number of rules 238 increases, an accuracy of a determination that speed 230 exceeds a particular speed limit 240 increases. Whenever speed 230 for set of vehicles 232 is greater than threshold 234, report 244 is generated.

In these depicted examples, report 244 is a data structure that contains information about vehicles, such as number of vehicles 204. The data structure may be, for example, a text file, a spreadsheet, an email message, a container, and/or other suitable types of data structures. The information may be, for example, an identification of speeding vehicles, average speed of vehicles on a road, and/or other suitable information. Information about a speeding vehicle may include, for example, a photograph of the vehicle, a video of the vehicle, a license plate number, a timestamp, a speed, and/or other suitable information.

Detection process 226 may determine whether number of vehicles 204 is present on road 206 by processing an infrared frame within infrared frames 222. For example, infrared frame 223 in infrared frames 222 may be processed to identify number of objects 246 based on heat 248 within infrared frame 223. More specifically, number of objects 246 may have a level of heat 248 different from an average level of heat 248 within infrared frame 223. In this manner, one or more of number of objects 246 may be identified as vehicles within number of vehicles 204.

In these illustrative examples, radar system 210 takes the form of laser radar unit 250. Of course, other types of radar systems may be used in addition to or in place of laser radar unit 250. For example, without limitation, a radar system using phased array antennas or a radar gun with an appropriate sized aperture may be used. In these examples, laser radar unit 250 may be implemented using light detection and ranging (LIDAR) technology.

When detection process 226 identifies set of vehicles 232 as exceeding threshold 234, detection process 226 generates report 244. Report 244 is an electronic file or other suitable type of data structure in these illustrative examples. Report 244 may include number of photographs 254, number of videos 255, and number of speeds 256. Each photograph in number of photographs 254 and/or each video in number of videos 255 includes a vehicle within set of vehicles 232. Further, in some advantageous embodiments, number of photographs 254 may be a single photograph containing all of the vehicles in set of vehicles 232, and number of videos 255 may be a single video containing all of the vehicles in set of vehicles 232. With this type of implementation, each vehicle may be marked and identified.

Further, report 244 also may include number of speeds 256. Each speed within number of speeds 256 is for a particular vehicle within set of vehicles 232.

Each photograph in number of photographs 254 and/or each video in number of videos 255 is configured such that a vehicle within set of vehicles 232 can be identified. For example, a photograph in number of photographs 254 may include a license plate of a vehicle. Also, the photograph may be such that the driver of the vehicle can be identified.

In some advantageous embodiments, a video in number of videos 255 may be configured to identify a vehicle within set of vehicles 232 that is changing lanes on road 206 at a speed greater than a threshold. The video also may be configured to identify a driver of a vehicle who is driving in a manner that endangers the driver or the drivers of other vehicles in set of vehicles 232 on road 206.

In some advantageous embodiments, report 244 may include other types of information in addition to number of photographs 254, number of videos 255, and number of speeds 256. For example, without limitation, in some advantageous embodiments, detection process 226 may perform character recognition to identify a license plate from a photograph and/or a video of the vehicle. In other advantageous embodiments, detection process 226 may perform facial recognition to identify a driver from the photograph and/or the video of the vehicle.

In still other advantageous embodiments, report 244 may include speed information 258 in addition to or in place of number of photographs 254 and number of speeds 256. In these illustrative examples, speed information 258 may identify an average speed of vehicles on road 206 over some selected period of time. Further, speed information 258 also may include, for example, without limitation, a standard deviation of speed, a maximum speed, an acceleration of a vehicle, a deceleration of a vehicle, and/or other suitable speed information. This information may be used by a transportation authority to make planning decisions. Further, the information also may be used to determine whether additional patrols by law enforcement officials may be needed in addition to speed detection system 202.

In these illustrative examples, report 244 is sent to location 260. Location 260 may be a remote location, such as remote location 130 in FIG. 1. Location 260 may be a location for an entity such as, for example, without limitation, a police station, a state highway patrol center, a transportation authority office, and/or some other suitable type of location.

In some advantageous embodiments, location 260 may be a storage unit within data processing system 212. The storage unit may be, for example, a memory, a server system, a database, a hard disk drive, a redundant array of independent disks, or some other suitable storage unit. The storage unit may be used to store report 244 until an entity, such as a law enforcement agency, requests report 244. In still other advantageous embodiments, location 260 may be an online server system configured to store report 244 for a selected period of time. This online server system may be remote to speed detection system 202. A police station may retrieve a copy of report 244 from the online server system at any time during the period of time.

The illustration of speed detection environment 200 in FIG. 2 is not meant to imply physical or architectural limitations to the manner in which different advantageous embodiments may be implemented. Other components in addition to and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

For example, in some advantageous embodiments, additional speed detection systems, in addition to speed detection system 202, may be present. In yet other advantageous embodiments, camera system 208 may only include visible light video camera 216. With this type of implementation, object recognition capabilities may be included in detection process 226. In some advantageous embodiments, camera system 208 may have a digital camera in the place of visible light video camera 216. In these embodiments, the digital camera may be capable of generating still images as opposed to video in the form of visible light video data stream 219 generated by visible light video camera 216.

In these illustrative examples, detection process 226 is depicted as a single process containing multiple capabilities. In other illustrative examples, detection process 226 may be divided into multiple modules or processes. Further, number of vehicles 204 may be moving in two directions on road 206, depending on the particular implementation. Camera system 208 may be configured to detect number of vehicles 204 moving in both directions to identify speeding vehicles.

In some advantageous embodiments, detection process 226 may be implemented using a numerical control program running in data processing system 212. In other advantageous embodiments, data processing system 212 may be configured to run a number of programs such that detection process 226 has artificial intelligence. The number of programs may include, for example, without limitation, a neural network, fuzzy logic, and/or other suitable programs. In these examples, artificial intelligence may allow detection process 226 to perform decision making, deduction, reasoning, problem solving, planning, and/or learning. In some examples, decision making may involve using a set of rules to perform tasks.

In still other advantageous embodiments, data processing system 212 may be located in a remote location, such as location 260. Video data stream 218 and number of speed measurements 228 may be sent from camera system 208 and radar system 210 over number of communications links 261 in a network to data processing system 212 at location 260 with this type of embodiment. In these examples, number of communications links 261 may include a number of wireless communications links, a number of optical links, and/or a number of wired communications links.

Figure 3:
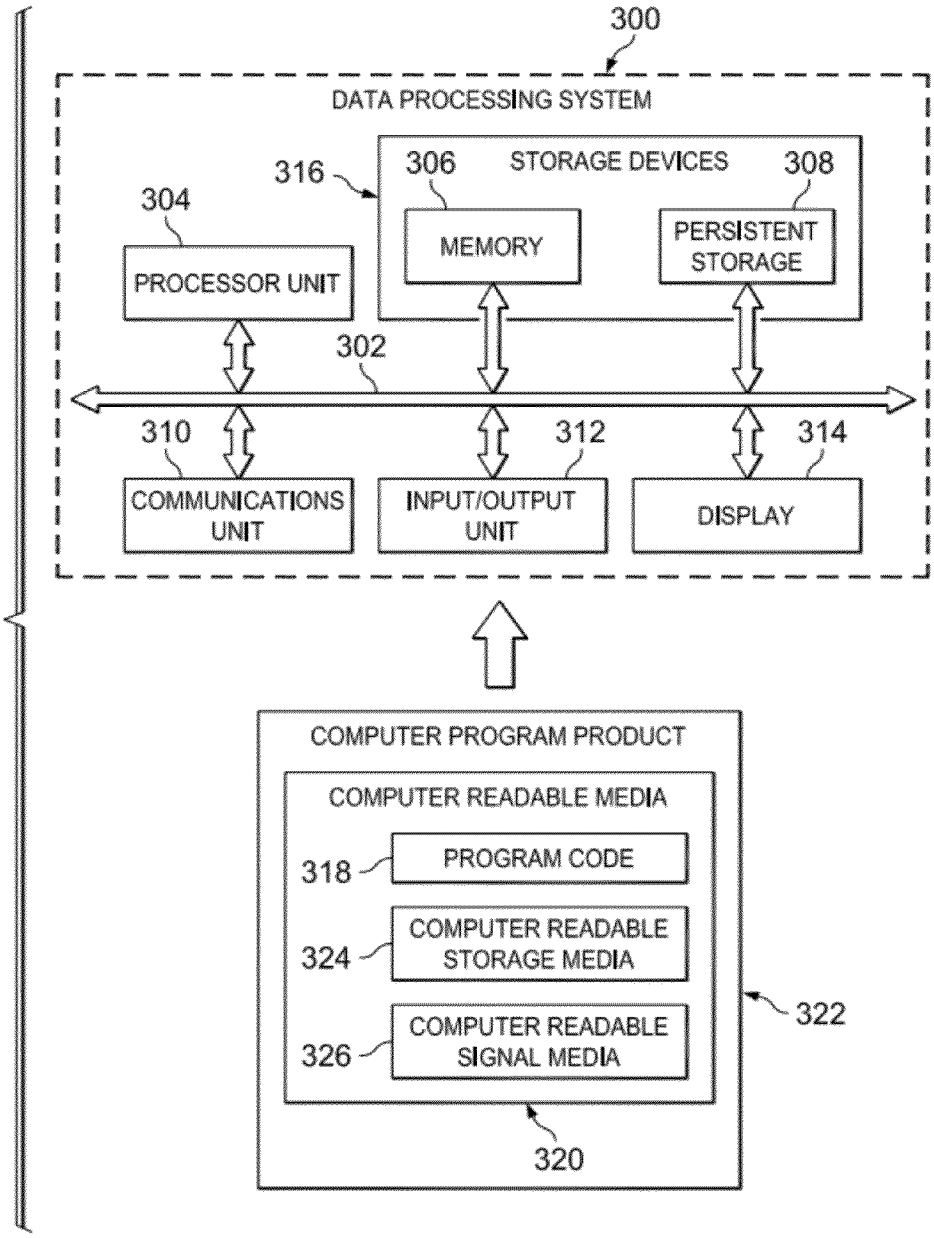
FIG. 3 is an illustration of a data processing system in accordance with an advantageous embodiment.

Turning now to FIG. 3, an illustration of a data processing system is depicted in accordance with an advantageous embodiment. Data processing system 300 is an example of one implementation for data processing system 212 in speed detection system 202 in FIG. 2.

In this illustrative example, data processing system 300 includes communications fabric 302, which provides communications between processor unit 304, memory 306, persistent storage 308, communications unit 310, input/output (I/O) unit 312, and display 314.

Processor unit 304 serves to execute instructions for software that may be loaded into memory 306. Processor unit 304 may be a set of one or more processors or may be a multiprocessor core, depending on the particular implementation. Further, processor unit 304 may be implemented using one or more heterogeneous processor systems in which a main processor is present with secondary processors on a single chip. As another illustrative example, processor unit 304 may be a symmetric multi-processor system containing multiple processors of the same type.

Memory 306 and persistent storage 308 are examples of storage devices 316. A storage device is any piece of hardware that is capable of storing information such as, for example, without limitation, data, program code in functional form, and/or other suitable information either on a temporary basis and/or a permanent basis. Memory 306, in these examples, may be, for example, a random access memory or any other suitable volatile or non-volatile storage device.

Persistent storage 308 may take various forms, depending on the particular implementation. For example, persistent storage 308 may contain one or more components or devices. For example, persistent storage 308 may be a hard drive, a solid-state drive, a flash memory, a rewritable optical disk, a rewritable magnetic tape, or some combination of the above. The media used by persistent storage 308 also may be removable. For example, a removable hard drive may be used for persistent storage 308.

Communications unit 310, in these examples, provides for communications with other data processing systems or devices. In these examples, communications unit 310 is a network interface card. Communications unit 310 may provide communications through the use of either or both physical and wireless communications links.

Input/output unit 312 allows for input and output of data with other devices that may be connected to data processing system 300. For example, input/output unit 312 may provide a connection for user input through a keyboard, a mouse, and/or some other suitable input device. Further, input/output unit 312 may send output to a printer. Display 314 provides a mechanism to display information to a user.

Instructions for the operating system, applications, and/or programs may be located in storage devices 316, which are in communication with processor unit 304 through communications fabric 302. In these illustrative examples, the instructions are in a functional form on persistent storage 308. These instructions may be loaded into memory 306 for execution by processor unit 304. The processes of the different embodiments may be performed by processor unit 304 using computer-implemented instructions, which may be located in a memory, such as memory 306. These instructions may be, for example, for detection process 226 in FIG. 2.

These instructions are referred to as program code, computer usable program code, or computer readable program code that may be read and executed by a processor in processor unit 304. The program code in the different embodiments may be embodied on different physical or tangible computer readable media, such as memory 306 or persistent storage 308.

Program code 318 is located in a functional form on computer readable media 320 that is selectively removable and may be loaded onto or transferred to data processing system 300 for execution by processor unit 304. Program code 318 and computer readable media 320 form computer program product 322 in these examples. In one example, computer readable media 320 may be computer readable storage media 324 or computer readable signal media 326. Computer readable storage media 324 may include, for example, an optical or magnetic disk that is inserted or placed into a drive or other device that is part of persistent storage 308 for transfer onto a storage device, such as a hard drive, that is part of persistent storage 308. Computer readable storage media 324 also may take the form of a persistent storage, such as a hard drive, a thumb drive, or a flash memory that is connected to data processing system 300. In some instances, computer readable storage media 324 may not be removable from data processing system 300.

Alternatively, program code 318 may be transferred to data processing system 300 using computer readable signal media 326. Computer readable signal media 326 may be, for example, a propagated data signal containing program code 318. For example, computer readable signal media 326 may be an electro-magnetic signal, an optical signal, and/or any other suitable type of signal. These signals may be transmitted over communications links, such as wireless communications links, an optical fiber cable, a coaxial cable, a wire, and/or any other suitable type of communications link. In other words, the communications link and/or the connection may be physical or wireless in the illustrative examples.

In some illustrative embodiments, program code 318 may be downloaded over a network to persistent storage 308 from another device or data processing system through computer readable signal media 326 for use within data processing system 300. For instance, program code stored in a computer readable storage media in a server data processing system may be downloaded over a network from the server to data processing system 300. The data processing system providing program code 318 may be a server computer, a client computer, or some other device capable of storing and transmitting program code 318.

The different components illustrated for data processing system 300 are not meant to provide architectural limitations to the manner in which different embodiments may be implemented. The different illustrative embodiments may be implemented in a data processing system including components in addition to or in place of those illustrated for data processing system 300. Other components shown in FIG. 3 can be varied from the illustrative examples shown. The different embodiments may be implemented using any hardware device or system capable of executing program code. As one example, the data processing system may include organic components integrated with inorganic components and/or may be comprised entirely of organic components excluding a human being. For example, a storage device may be comprised of an organic semiconductor.

As another example, a storage device in data processing system 300 is any hardware apparatus that may store data. Memory 306, persistent storage 308, and computer readable media 320 are examples of storage devices in a tangible form.

In another example, a bus system may be used to implement communications fabric 302 and may be comprised of one or more buses, such as a system bus or an input/output bus. Of course, the system bus may be implemented using any suitable type of architecture that provides for a transfer of data between different components or devices attached to the system bus. Additionally, a communications unit may include one or more devices used to transmit and receive data, such as a modem or a network adapter. Further, a memory may be, for example, memory 306 or a cache such as found in an interface and memory controller hub that may be present in communications fabric 302.

Figure 4:
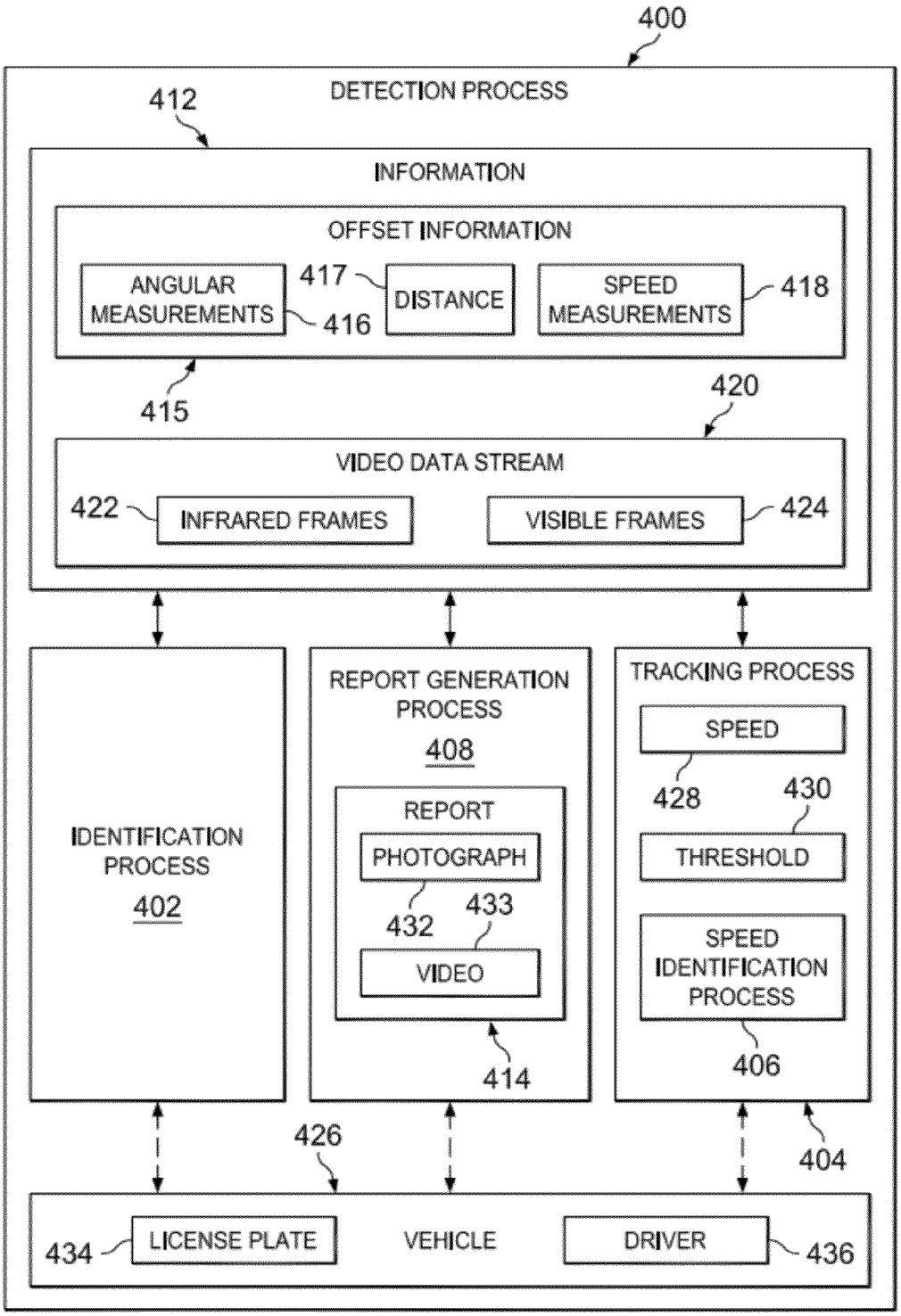
FIG. 4 is an illustration of report generation by a detection process in accordance with an advantageous embodiment.

With reference now to FIG. 4, an illustration of report generation by a detection process is depicted in accordance with an advantageous embodiment. In this illustrative example, detection process 400 is an example of one implementation for detection process 226 in FIG. 2.

In this illustrative example, detection process 400 includes identification process 402, tracking process 404, and report generation process 408. Detection process 400 receives information 412 for use in generating report 414. Information 412 includes speed measurements 418 and video data stream 420.

Video data stream 420, in this illustrative example, includes infrared frames 422 and visible frames 424. Infrared frames 422 are used by identification process 402 to identify vehicles, such as vehicle 426. Additionally, infrared frames 422 are used by tracking process 404 to track vehicle 426 within infrared frames 422.

Further, tracking process 404 controls a radar system, such as radar system 210 in FIG. 2. The radar system provides speed measurements 418. In these examples, speed measurements 418 include a measurement of speed 428 of vehicle 426.

Speed measurements 418, in these depicted examples, may require adjustments. For example, if the speed detection system is offset from the road, adjustments may be made to speed measurements 418. These adjustments are made using offset information 415.

As depicted, offset information 415 includes angular measurements 416 and distance 417. Angular measurements 416 may include measurements of an angle of elevation and/or an angle of azimuth relative to vehicle 426 on the road. Distance 417 is a measurement of distance relative to vehicle 426 on the road. In these advantageous embodiments, angular measurements 416 are obtained by the radar system.

In this illustrative example, report generation process 408 generates report 414 for vehicle 426 if speed 428 is greater than threshold 430. If speed 428 exceeds threshold 430, vehicle 426 is included in report 414.

Additionally, photograph 432 and/or video 433 are associated with vehicle 426 and placed in report 414. Both photograph 432 and/or video 433 may be obtained from visible frames 424 in these illustrative examples. Photograph 432 may be selected such that license plate 434 and driver 436 of vehicle 426 can be seen within photograph 432.

Further, in some examples, photograph 432 may include only a portion of the information provided in visible frames 424. For example, a visible frame in visible frames 424 may be cropped to create photograph 432. The cropping may be performed to include, for example, only one vehicle that has been identified as exceeding threshold 430.

In the illustrative examples, adjustments may be made to a visible frame to sharpen the image, rotate the image, and/or make other adjustments. Further, in some advantageous embodiments, a marker may be added to photograph 432 to identify the location on the vehicle at which a laser beam of the radar system hit the vehicle to make speed measurements 418.

This marker may be, for example, without limitation, an illumination of a pixel in a photograph, a text label, a tag, a symbol, and/or some other suitable marker. In other advantageous embodiments, a marker may be added to video 433 to track a vehicle of interest in video 433.

When appropriate, report 414 may be sent to a remote location for processing. Report 414 may include information for just vehicle 426 or other vehicles that have been identified as exceeding threshold 430.

The illustration of detection process 400 in FIG. 4 is not meant to imply physical or architectural limitations to the manner in which different advantageous embodiments may be implemented. Other components in addition to and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

For example, detection process 400 may include identification process 402 within tracking process 404. In this example, identification process 402 may be configured to control radar system 210 in FIG. 2 to provide speed measurements 418. In some advantageous embodiments, report 414 may include a number of photographs in addition to photograph 432. The number of photographs may identify vehicle 426 at different points in time along a road.

Figure 5:
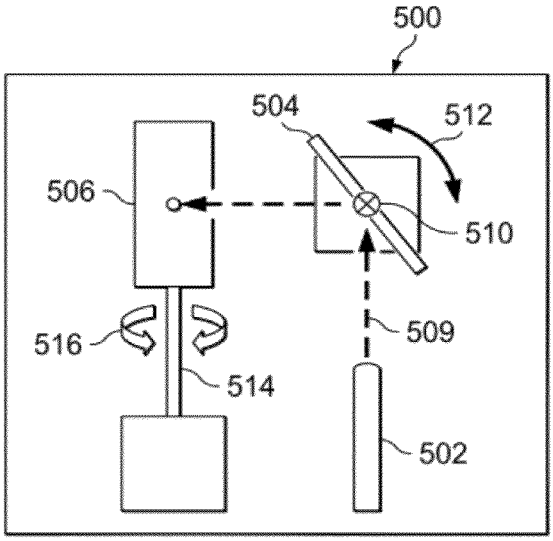
FIG. 5 is an illustration of a laser radar unit in accordance with an advantageous embodiment.

With reference now to FIG. 5, an illustration of a laser radar unit is depicted in accordance with an advantageous embodiment. In this illustrative example, laser radar unit 500 is an example of one implementation of laser radar unit 250 in FIG. 2. As depicted, laser radar unit 500 includes laser radar source unit 502, elevation mirror 504, and azimuth mirror 506.

Laser radar source unit 502 generates laser beam 509, which travels to elevation mirror 504. Elevation mirror 504 may rotate about axis 510 in the direction of arrow 512. Laser beam 509 reflects off of elevation mirror 504 and travels to azimuth mirror 506. Azimuth mirror 506 may rotate about axis 514 in the direction of arrow 516. Laser beam 509 reflects off of azimuth mirror 506 towards a target, such as a vehicle.

The rotations of elevation mirror 504 and azimuth mirror 506 allow for laser beam 509 to be directed along two axes. These axes, in these illustrative examples, are elevation and azimuth with respect to a road. Elevation is in an upwards and downwards direction with respect to a horizontal position on a road. Azimuth is in a direction across the road. In these examples, elevation mirror 504 and/or azimuth mirror 506 rotate such that laser beam 509 moves along elevation and/or azimuth. The movement of laser beam 509 also may be referred to as scanning.

Figure 6:
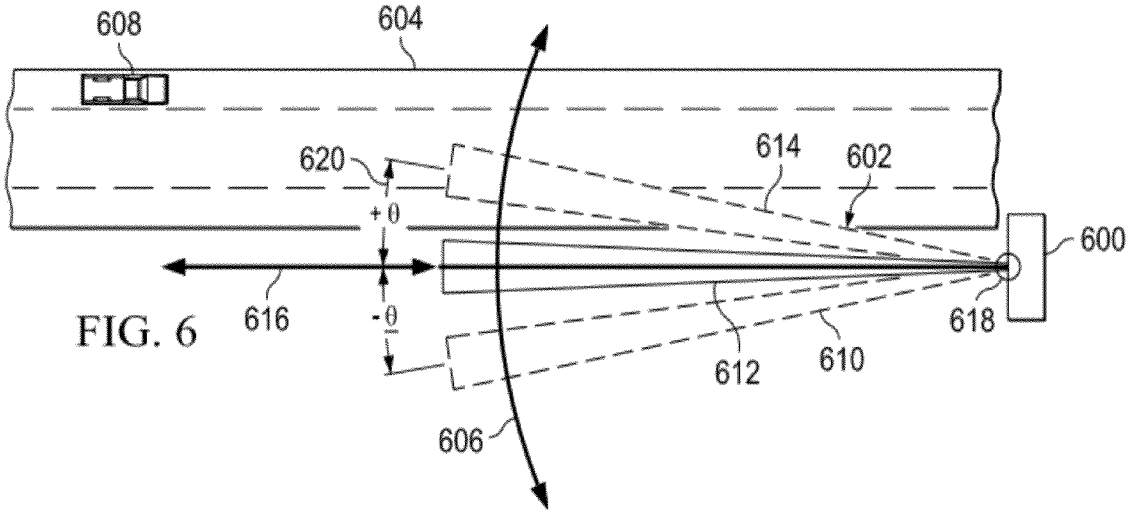
FIG. 6 is an illustration of a top view of a laser radar unit in accordance with an advantageous embodiment.

With reference now to FIG. 6, an illustration of a top view of a laser radar unit is depicted in accordance with an advantageous embodiment. In this illustrative example, laser radar unit 600 is an example of one implementation for laser radar unit 250 in FIG. 2. More specifically, laser radar unit 600 may be implemented using the configuration shown for laser radar unit 500 in FIG. 5.

As depicted, laser radar unit 600 emits laser beam 602. Laser radar unit 600 is configured to move laser beam 602 across road 604 in the direction of arrow 606. This direction is an azimuth angular direction. In these depicted examples, laser radar unit 600 receives instructions that identify the direction in which laser beam 602 is emitted. These instructions may be received from a data processing system, such as data processing system 212 in FIG. 2. These instructions may instruct laser radar unit 600 to emit laser beam 602 in the direction of an object of interest.

For example, laser radar unit 600 may be instructed to emit laser beam 602 towards vehicle 608, which is detected on road 604. Vehicle 608 may be detected by, for example, detection process 226 running on data processing system 212 in FIG. 2. Laser beam 602 sweeps from direction 610, to direction 612, and to direction 614. Direction 614 is the direction in which laser beam 602 hits vehicle 608. Directions 610, 612, and 614 are angular azimuth directions in this depicted example.

Laser radar unit 600 is configured to measure the offset at which vehicle 608 on road 604 is detected with respect to laser radar unit 600. A first portion of this offset is determined by the angle of azimuth at which the vehicle is detected.

The angle of azimuth is measured with respect to axis 616 that passes through center 618 of laser radar unit 600. Axis 616 is parallel to road 604 in this depicted example. The angle of azimuth may have a value of plus or minus $\theta$, where $\theta$ is in radians. In this illustrative example, vehicle 608 is offset from laser radar unit 600 by angle of azimuth 620. Angle of azimuth 620 is plus $\theta$ radians in this example.

In these depicted examples, laser radar unit 600 is configured to measure angle of azimuth 620 as vehicle 608 moves on road 604. For example, vehicle 608 may have a different angle of azimuth if vehicle 608 changes lanes on road 604.

Figure 7:
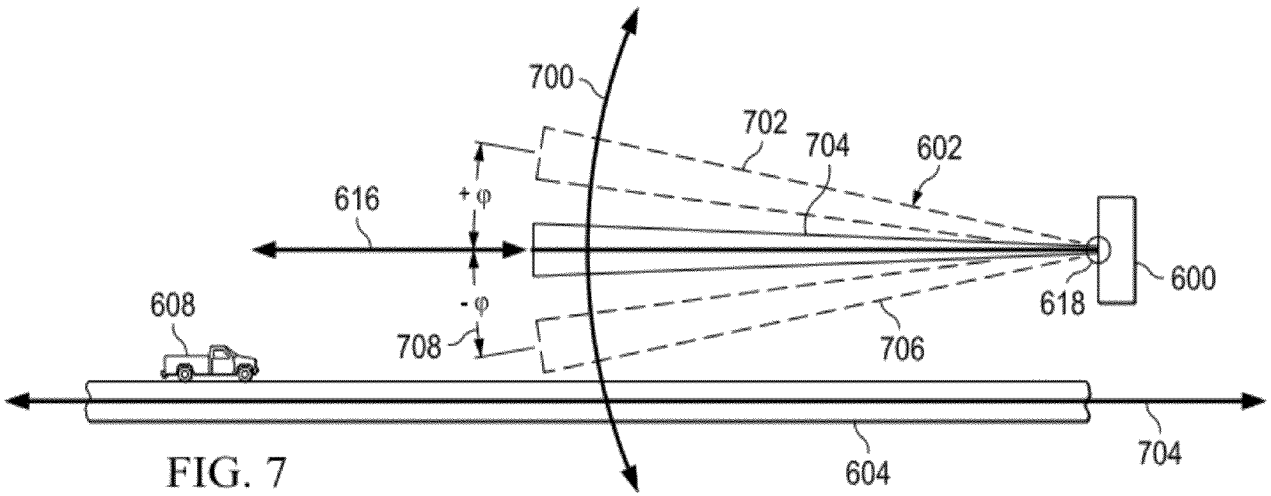
FIG. 7 is an illustration of a side view of a laser radar unit in accordance with an advantageous embodiment.

With reference now to FIG. 7, an illustration of a side view of a laser radar unit is depicted in accordance with an advantageous embodiment. In this illustrative example, laser radar unit 600 is also configured to move laser beam 602 upwards and downwards with respect to road 604 in the direction of arrow 700. This direction is an elevation angular direction.

When vehicle 608 is detected by detection process 226 in FIG. 2, laser radar unit 600 is also instructed to move laser beam 602 in the elevation angular direction of arrow 700 until laser beam 602 hits vehicle 608. As depicted, laser beam 602 sweeps from direction 702, to direction 704, and to direction 706. Direction 706 is the direction in which laser beam 602 hits vehicle 608. Directions 702, 704, and 706 are elevation angular directions in this example.

In direction 706, laser radar unit 600 is configured to measure a second portion of the offset at which vehicle 608 on road 604 is detected with respect to laser radar unit 600. This second portion of the offset is determined by the angle of elevation at which the vehicle is detected.

The angle of elevation is measured with respect to axis 616 that passes through center 618 of laser radar unit 600. The angle of elevation may have a value of plus or minus $\phi$, where $\phi$ is in radians. In this illustrative example, vehicle 608 is offset from laser radar unit 600 by angle of elevation 708. Angle of elevation 708 is minus $\phi$ radians in this example.

In these depicted examples, laser radar unit 600 is configured to measure angle of elevation 708 as vehicle 608 moves on road 604 towards laser radar unit 600. As one example, if road 604 is on a hill, angle of elevation 708 may change as vehicle 608 moves on road 604 towards laser radar unit 600.

As depicted in FIG. 6 and FIG. 7, laser radar unit 600 is configured to measure an angle of azimuth and an angle of elevation for a vehicle, such as vehicle 608. The angle of azimuth and the angle of elevation form offset information, such as offset information 229 in FIG. 2. This offset measurement may be used by detection process 226 in FIG. 2 to make a number of speed measurements for vehicle 608.

Figure 8:
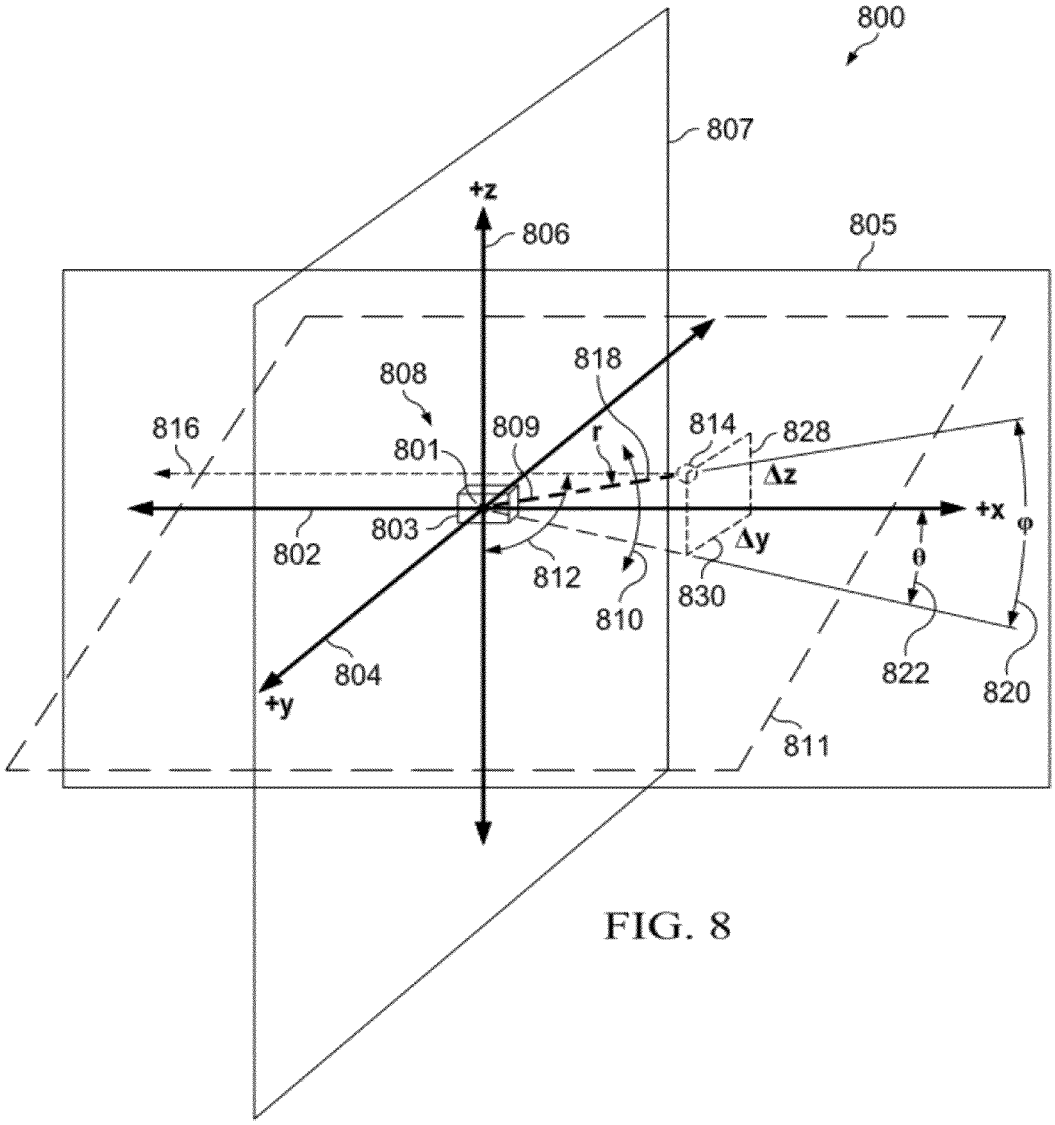
FIG. 8 is an illustration of a coordinate system in accordance with an advantageous embodiment.

With reference now to FIG. 8, an illustration of a coordinate system is depicted in accordance with an advantageous embodiment. In this example, coordinate system 800 is used to describe the two-axis scanning that may be performed using laser radar unit 801 in speed detection system 803. Laser radar unit 801 in speed detection system 803 may be implemented using laser radar unit 250 in speed detection system 202 in FIG. 2. In particular, laser radar unit 801 may be implemented using laser radar unit 500 in FIG. 5.

As depicted, coordinate system 800 includes X-axis 802, Y-axis 804, and Z-axis 806. X-axis 802 and Y-axis 804 form XY plane 811. X-axis 802 and Z-axis 806 form XZ plane 805. Y-axis 804 and Z-axis 806 form YZ plane 807. As depicted, point 808 is an origin for a location of speed detection system 803.

In particular, laser radar unit 801 in speed detection system 803 may emit laser beam 809. In this example, laser beam 809 may be moved upwards and downwards with respect to Z-axis 806 as indicated by arrow 810. Laser beam 809 also may be moved back and forth with respect to Y-axis 804 as indicated by arrow 812. Further, laser radar unit 801 may emit laser beam 809 towards object 814, which is travelling in the direction of arrow 816 in these examples.

Laser radar unit 801 is configured to measure distance 818, angle of elevation 820, and angle of azimuth 822 with point 808 as the origin. In this illustrative example, distance 818 is the radial distance, r, from point 808 to object 814. Angle of elevation 820 is an offset measured from XY plane 811 to object 814. Angle of azimuth 822 is an offset measured from XZ plane 805 to object 814. As depicted in these examples, distance 818, angle of elevation 820, and angle of azimuth 822 vary in time as object 814 travels in the direction of arrow 816. In this depicted example, arrow 816 may be substantially parallel to X-axis 802.

In these illustrative examples, distance 818, angle of elevation 820, and angle of azimuth 822 form offset information for object 814. This offset information identifies the offset of object 814 with respect to speed detection system 202 in FIG. 2 at point 808. For example, elevation offset ΔZ 828 and azimuth offset ΔY 830 for object 814 may be determined using laser radar unit 801.

Laser radar unit 801 may be configured to measure the time derivatives of distance 818, angle of elevation 820, and angle of azimuth 822. These time derivatives are given by the following three equations:

$$r' = \frac{dr}{dt}, \tag{1}$$

$$\theta' = \frac{d\theta}{dt}, \text{ and} \tag{2}$$

$$\varphi' = \frac{d\varphi}{dt}. \tag{3}$$

In these equations, r is distance 818, ϕ is angle of elevation 820, θ is angle of azimuth 822, and t is time. In these illustrative examples, r is in miles, r' is in miles per hour, θ and ϕ are in radians, and t is in hours. In other advantageous embodiments, different units may be used. In these illustrative examples, laser radar unit 801 may use the Doppler shift phenomenon to calculate r'.

Using equations 1, 2, and 3, the speed of object 814 may be calculated with the following equation:

$$v = r'\cos(\phi)\cos(\theta) - r\sin(\phi)\cos(\theta)\phi' - r\cos(\phi)\sin(\theta)\cos(\theta)\theta'. \tag{4}$$

In this equation, v is the speed of object 814.

Figure 9:
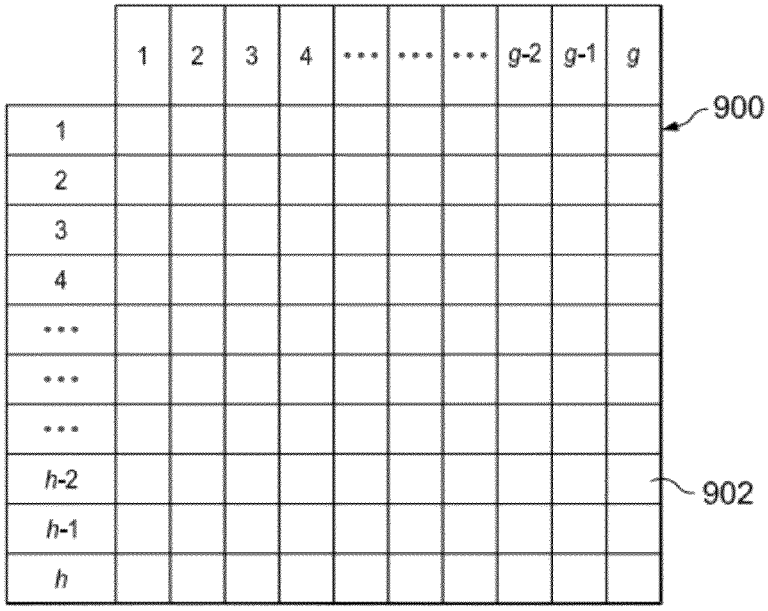
FIG. 9 is an illustration of an infrared frame in accordance with an advantageous embodiment.

With reference now to FIG. 9, an illustration of an infrared frame is depicted in accordance with an advantageous embodiment. In this illustrative example, an infrared frame is an example of one implementation of an infrared frame in infrared frames 222 in FIG. 2. Infrared frame 900 is generated by infrared camera 214 in FIG. 2 in these examples.

Infrared frame 900 is comprised of pixels 902. In particular, infrared frame 900 has g×h pixels 902. As depicted, infrared frame 900 is related to coordinate system 800 in FIG. 8. For example, g is a horizontal index for infrared frame 900 relating to Y-axis 804 in XY plane 811, and h is a vertical index for infrared frame 900 relating to Z-axis 806 in XZ plane 805.

In the different advantageous embodiments, traffic may be identified as being present when vehicles are present in infrared frame 900. In this illustrative example, when infrared frame 900 is generated when no traffic is present, infrared frame 900 comprises $B_{ij}$. In other words, the values of pixels 902 in infrared frame 900 are $B_{ij}$, where i is a value selected from 1 through g, and j is a value selected from 1 through h. When infrared frame 900 is generated when traffic is present, infrared frame 900 comprises $F_{ij}$. In other words, the values of pixels 902 in infrared frame 900 are $F_{ij}$.

Figure 10:
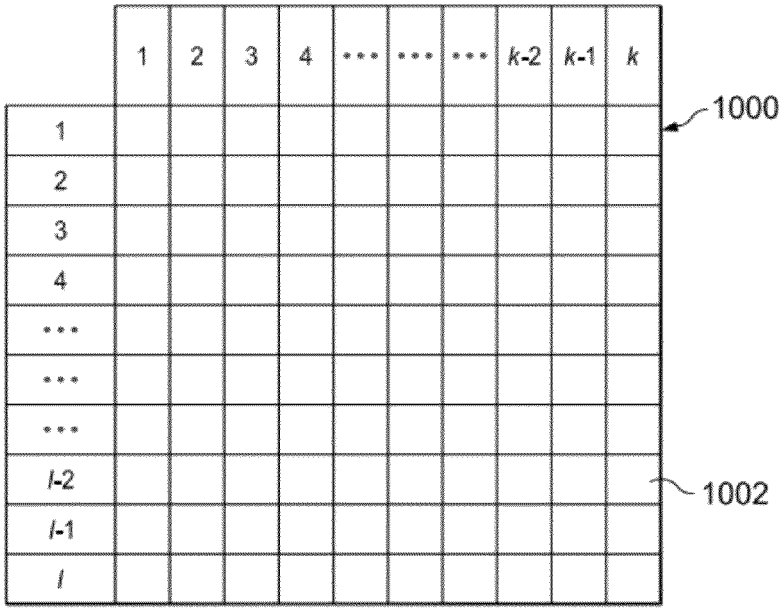
FIG. 10 is an illustration of a visible frame in accordance with an advantageous embodiment.

With reference now to FIG. 10, an illustration of a visible frame is depicted in accordance with an advantageous embodiment. In this illustrative example, the visible frame is an example of one implementation of a visible frame in visible frames 224 in FIG. 2. Visible frame 1000 is generated by visible light video camera 216 in FIG. 2.

Visible frame 1000 has pixels 1002. In particular, visible frame 1000 has k×l pixels. As depicted, visible frame 1000 is related to coordinate system 800 in FIG. 8. For example, k is a horizontal index for visible frame 1000 relating to Y-axis 804 in XY plane 811, and 1 is a vertical index for visible frame 1000 relating to Z-axis 806 in YZ plane 807.

Figure 11:
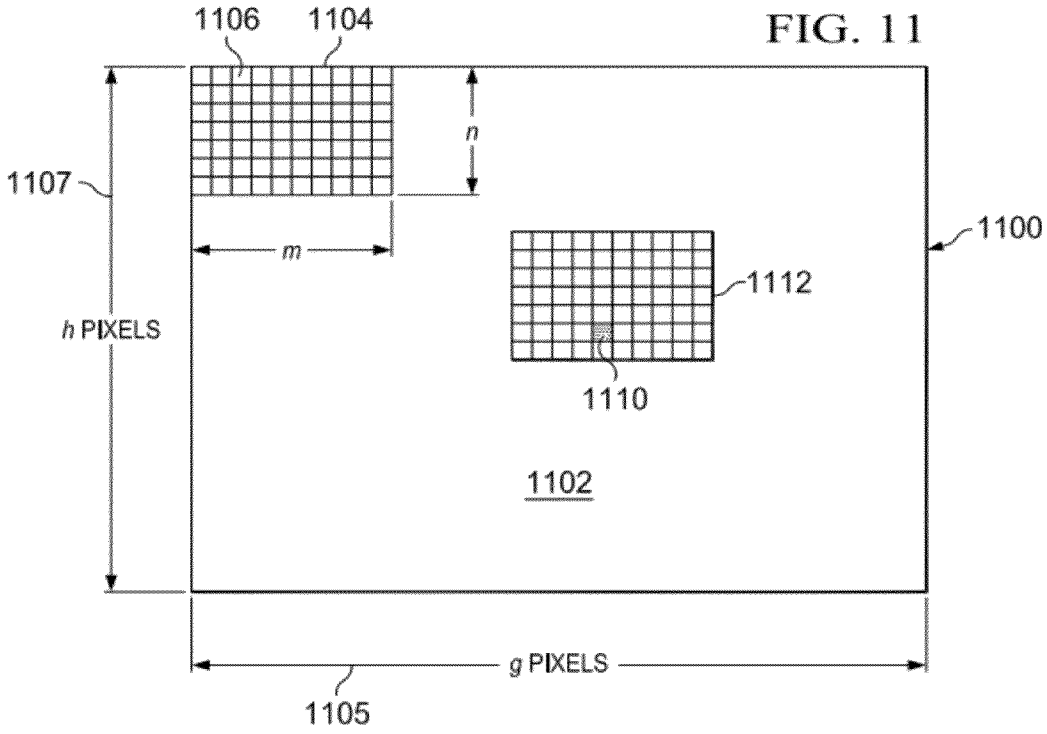
FIGS. 11-13 are illustrations of an infrared frame in accordance with an advantageous embodiment.
Figure 12:
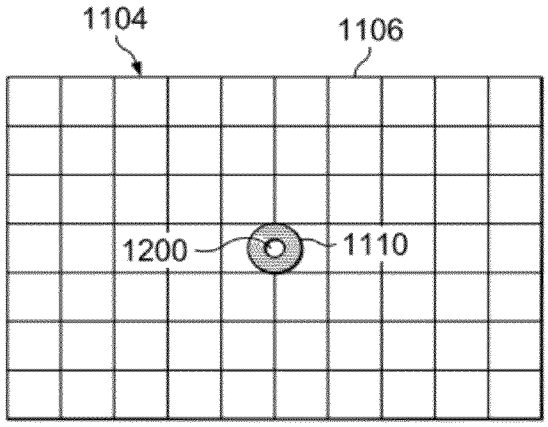
Figure 13:
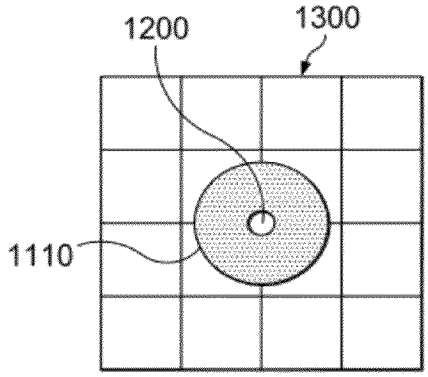

Turning now to FIGS. 11-13, illustrations of an infrared frame are depicted in accordance with an advantageous embodiment. In this illustrative example, infrared frame 1100 is an example of one implementation of infrared frame 900 in FIG. 9. Infrared frame 1100 is generated by infrared camera 214 in FIG. 2 in these examples. Infrared frame 1100 is processed using a processor unit that may be located in data processing system 212 in FIG. 2.

In these illustrative examples, infrared frame 1100 is depicted at various stages of processing by detection process 226 running on data processing system 212 in FIG. 2. More specifically, detection process 400 in FIG. 4 processes infrared frame 1100. In these illustrative examples, identification process 402 in detection process 400 is used to identify vehicles in infrared frame 1100.

Infrared frame 1100 has g×h pixels 1102. In these illustrative examples, detection process 226 is configured to move window 1106 within infrared frame 1100. Window 1106 has m×n pixels 1104 in this example. Window 1106 defines an area in infrared frame 1100 in which pixels and/or other information may be processed by detection process 226.

In these examples, detection process 226 moves window 1106 by one or more pixels in horizontal direction 1105 and/or vertical direction 1107 of infrared frame 1100. For example, window 1106 moves in horizontal direction 1105 by Δg pixels and/or in vertical direction 1107 by Δh pixels.

As window 1106 moves within infrared frame 1100, the pixels in window 1106 are processed to determine whether a number of heat signatures are present within window 1106. As depicted in this example, a heat signature for object 1110 is detected in window 1106 when window 1106 is at position 1112 within infrared frame 1100. The heat signature for object 1110 is detected when object 1110 has a level of heat substantially equal to or greater than a selected threshold.

At position 1112 in FIG. 11, the center of object 1110 detected in window 1106 has coordinates $(\bar{g},\bar{h})$ in infrared frame 1100. One method for calculating these coordinates uses a weighted average, which is calculated using the following equations:

$$\bar{g} = \frac{\sum_{i=1+\Delta g}^{m+\Delta g}\sum_{j=1+\Delta h}^{n+\Delta h} i*(F_{ij}-B_{ij})}{\sum_{i=1+\Delta g}^{m+\Delta g}\sum_{j=1+\Delta h}^{n+\Delta h}(F_{ij}-B_{ij})}, \text{ and} \tag{5}$$

$$\bar{h} = \frac{\sum_{i=1+\Delta g}^{m+\Delta g}\sum_{j=1+\Delta h}^{n+\Delta h} j*(F_{ij}-B_{ij})}{\sum_{i=1+\Delta g}^{m+\Delta g}\sum_{j=1+\Delta h}^{n+\Delta h}(F_{ij}-B_{ij})}. \tag{6}$$

In these equations, $\bar{g}$ is the horizontal position of the center of object 1110 within infrared frame 1100, and $\bar{h}$ is the vertical position of the center of object 1110 within infrared frame 1100.

Further, $F_{ij}$ are the values of the pixels of infrared frame 1100 with traffic present. This traffic includes at least object 1110. In these examples, $B_{ij}$ are the values of the pixels of another infrared frame similar to infrared frame 1100 when object 1110 and other traffic are not present. In other words, $B_{ij}$ provides reference values. These reference values are for the background of the scene for which infrared frame 1100 is generated. This background does not include object 1110 or other traffic. In the different advantageous embodiments, $B_{ij}$ is subtracted from $F_{ij}$ such that the background is not processed when calculating the center for object 1110.

Additionally, Δg and Δh are limited by the following relationships:

$$\Delta g=0,1,2 \ldots (g-m), \text{ and} \tag{7}$$

$$\Delta h=0,1,2 \ldots (h-n). \tag{8}$$

In some advantageous embodiments, a point in time may not occur in which no traffic is present in the scene for which infrared frame 1100 is generated. In these examples, the values of $B_{ij}$ may be set to zero. Further, in other advantageous embodiments, $B_{ij}$ may be updated with new reference values based on a condition being met. This condition may be, for example, without limitation, a period of time, the occurrence of an event, a request for new reference values, and/or some other suitable condition. In yet other illustrative examples, may be updated each time detection process 226 detects the absence of traffic in the scene.

Turning now to FIG. 12, detection process 226 in FIG. 2 centers window 1106 around object 1110. In particular, detection process 226 finds center 1200 of object 1110 and re-centers window 1106 substantially around center 1200 of object 1110. Center 1200 of object 1110 also may be referred to as a centroid.

Turning now to FIG. 13, window 1300 is depicted in accordance with an advantageous embodiment. In this illustrative example, once window 1106 is centered around object 1110, detection process 226 resizes window 1106 to form window 1300. Window 1300 remains centered around object 1110 in this example. Window 1300 is resized to zoom in on a portion of window 1106 with object 1110. This resizing may be performed to isolate object 1110 from other objects that may be detected within infrared frame 1100.

Figure 14:
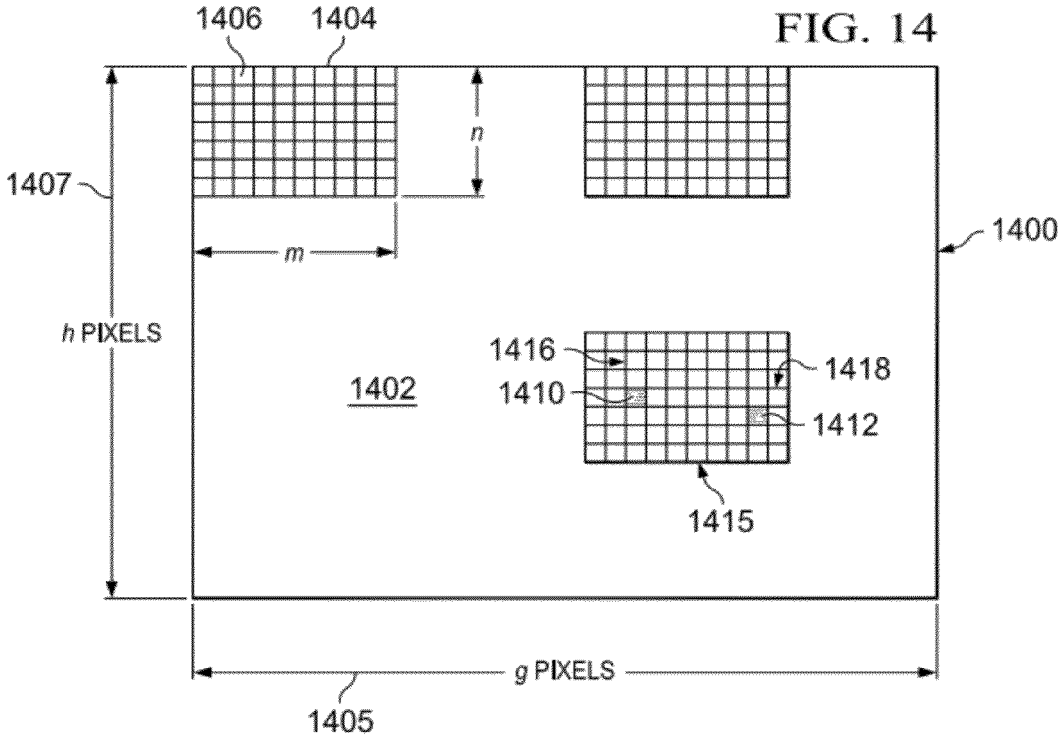
FIGS. 14-16 are illustrations of an infrared frame in accordance with an advantageous embodiment.
Figure 15:
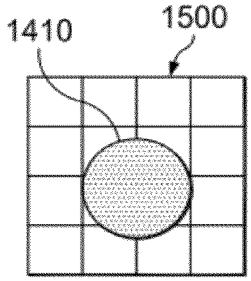
Figure 16:
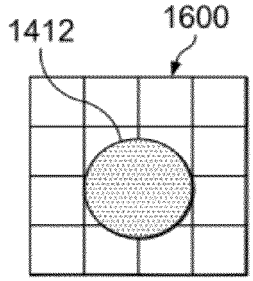

Turning now to FIGS. 14-16, illustrations of an infrared frame are depicted in accordance with an advantageous embodiment. In this illustrative example, infrared frame 1400 is an example of one implementation of infrared frame 900 in FIG. 9. Infrared frame 1400 is generated by infrared camera 214 in FIG. 2 and processed using a processor unit, such as data processing system 212 in FIG. 2. In these illustrative examples, infrared frame 1400 is depicted at various stages of processing by detection process 226 in FIG. 2. More specifically, identification process 402 in detection process 400 in FIG. 4 processes the pixels in infrared frame 1400 to identify objects of interest.

In FIG. 14, infrared frame 1400 has g×h pixels 1402. In these illustrative examples, detection process 226 is configured to move window 1406 within infrared frame 1400. Window 1406 has m×n pixels 1404 in this example. Window 1406 is moved by one or more pixels in horizontal direction 1405 and/or vertical direction 1407 of infrared frame 1400. For example, window 1406 moves in horizontal direction 1405 by Δg pixels and/or in vertical direction 1407 by Δh pixels.

As depicted in this example, a heat signature for object 1410 and a heat signature for object 1412 are detected when window 1406 is at position 1416 within infrared frame 1400. Object 1410 and object 1412 are objects of interest in these examples.

In these illustrative examples, an object of interest is an object with a heat signature that has a level of heat in a portion of infrared frame 1400 that is different from the levels of heat detected in other portions of infrared frame 1400. The difference may be by an amount that is sufficient to indicate that the object is present. For example, when object 1410 is a vehicle, the level of heat detected for object 1410 may differ from the level of heat detected for the road on which the vehicle moves by an amount that is indicative of a presence of object 1410 on the road. This difference in the level of heat may vary spatially and temporally in these examples.

In other advantageous embodiments, an object may be identified as an object of interest by taking into account other features in addition to heat signatures. The other features may include, for example, without limitation, a size of the object, a direction of movement of the object, and/or other suitable features.

In this illustrative example, the positions of object 1410 and object 1412 within window 1406 are then identified. Portion 1416 of window 1406 contains object 1410, and portion 1418 of window 1406 contains object 1412. Detection process 226 creates two new windows within infrared frame 1400 in place of window 1406 as depicted in FIG. 15 and FIG. 16 as follows.

In FIG. 15, window 1500 is depicted with object 1410. Window 1500 is centered around object 1410 and is configured such that object 1410 is isolated from object 1412 and any other objects that may be detected within infrared frame 1400 in FIG. 14.

In FIG. 16, window 1600 is depicted with object 1412. Window 1600 is centered around object 1412 and is configured such that object 1412 is isolated from object 1410 and any other objects that may be detected within infrared frame 1400 in FIG. 14. In some advantageous embodiments, window 1600 may be created from a different infrared frame than infrared frame 1400. For example, window 1600 may be created from a next infrared frame in a sequence of infrared frames containing infrared frame 1400.

In the different advantageous embodiments, window 1500 and window 1600 may be created in a sequential order. For example, window 1500 is created and centered around object 1410. Thereafter, window 1600 is created and centered around object 1412. In other advantageous embodiments, window 1500 and window 1600 may be created at substantially the same time. The order in which window 1500 and window 1600 are created and processed may depend on the implementation of data processing system 212 in FIG. 2.

Figure 17:
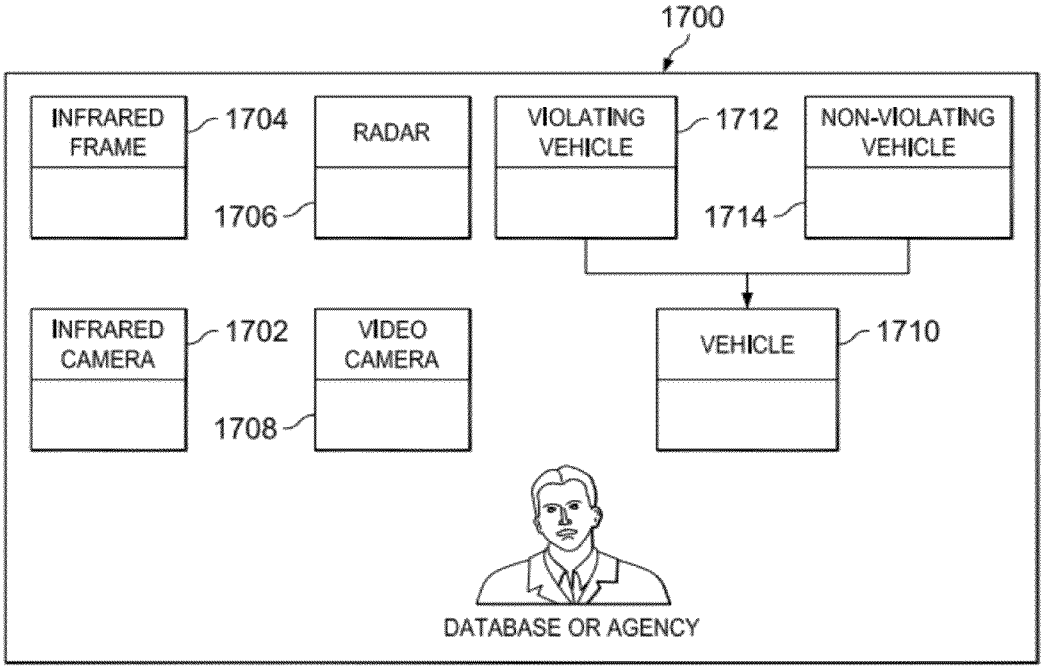
FIG. 17 is an illustration of data that is processed by a data processing system in accordance with an advantageous embodiment.

With reference now to FIG. 17, an illustration of data that is processed by a data processing system is depicted in accordance with an advantageous embodiment. In this illustrative example, data 1700 may be processed by detection process 226 running in data processing system 212 in FIG. 2. More specifically, data 1700 may be processed by detection process 400 in FIG. 4.

Data 1700 includes infrared camera class 1702, infrared frame class 1704, radar class 1706, video camera class 1708, and vehicle class 1710. In these illustrative examples, vehicle class 1710 may include violating vehicle subclass 1712 and non-violating vehicle subclass 1714.

Each of the classes in data 1700 may comprise one or more objects. In these illustrative examples, each object is an instance of a class. For example, infrared camera class 1702 has one infrared camera object. The infrared camera object is one instance of infrared camera class 1702. In this example, the infrared camera object comprises data for infrared camera 214 in FIG. 2.

As another example, infrared frame class 1704 may have a number of infrared frame objects. Each infrared frame object for infrared frame class 1704 may be unique in position, size, and time. In these illustrative examples, each infrared frame object may comprise data for an infrared frame generated by infrared camera 214 in FIG. 2.

Figure 18:
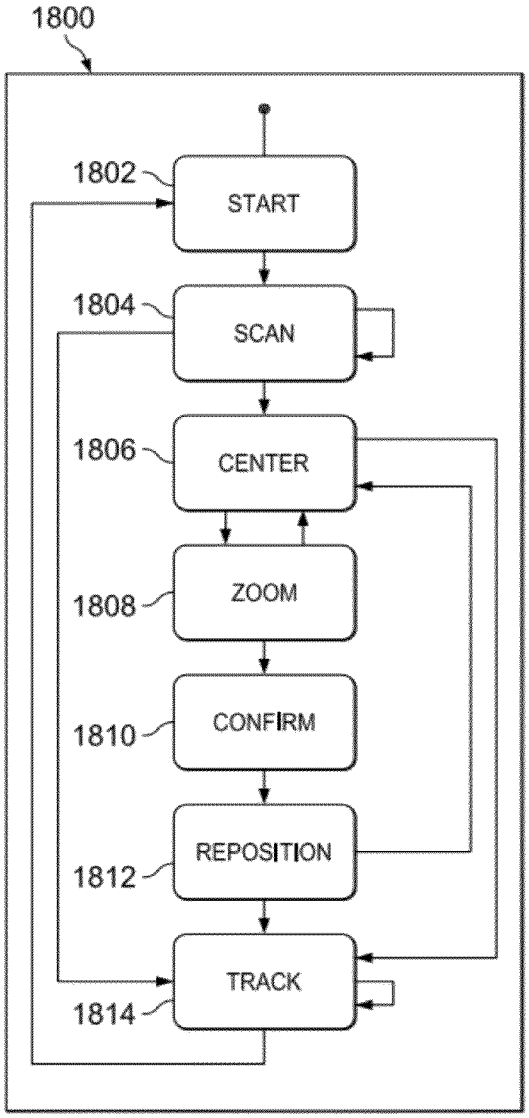
FIG. 18 is an illustration of a state diagram for an infrared frame object in accordance with an advantageous embodiment.

With reference now to FIG. 18, an illustration of a state diagram for an infrared frame object is depicted in accordance with an advantageous embodiment. In this illustrative example, infrared frame object 1800 is an object that may be processed by a processor unit in data processing system 212 in FIG. 2. More specifically, infrared frame object 1800 is an example of one infrared frame object within infrared frame class 1704 in FIG. 17 that may be processed by detection process 226 in FIG. 2.

In these illustrative examples, infrared frame object 1800 is an example of data that may be stored for an infrared frame, such as infrared frame 223 in FIG. 2. Infrared frame object 1800 has start state 1802, scan state 1804, center state 1806, zoom state 1808, confirm state 1810, reposition state 1812, and track state 1814.

In these illustrative examples, start state 1802 may be initiated when infrared camera 214 in FIG. 2 is turned on. Infrared frame object 1800 then transitions to scan state 1804. In scan state 1804, detection process 226 processes infrared frame object 1800 to detect heat signatures of vehicles of interest. This detection may be performed by identification process 402 in detection process 400 in FIG. 4. In particular, identification process 402 may use a window, such as window 1106 in FIG. 11 to detect heat signatures within infrared frame object 1800.

Once a heat signature for an object is detected, infrared frame object 1800 transitions to center state 1806. In center state 1806, identification process 402 centers the window within infrared frame object 1800 around the vehicle. Identification process 402 also may use information from laser radar unit 250 in FIG. 2 to locate the detected heat signature and confirm that the heat signature is for a vehicle.

Once the window is centered around the vehicle, infrared frame object 1800 transitions to zoom state 1808. In zoom state 1808, identification process 402 may zoom in and/or out of the window. Further, identification process 402 may resize the window within infrared frame object 1800 to isolate the detected vehicle. Still further, information from laser radar unit 250 may be used to confirm the position of the vehicle when in zoom state 1808.

Thereafter, infrared frame object 1800 transitions to confirm state 1810. In confirm state 1810, identification process 402 determines whether the detected vehicle is to be tracked by, for example, tracking process 404. Identification process 402 may use information from laser radar unit 250 to make this determination. For example, laser radar unit 250 may provide angular measurements 416, speed measurements 418, and distance 417 as depicted in FIG. 4. Once identification process 402 makes this determination, infrared frame object 1800 enters reposition state 1812.

In reposition state 1812, the window used to scan for vehicles within infrared frame object 1800 is configured to scan for additional heat signatures for additional vehicles of interest within infrared frame object 1800. In other words, the window is moved within infrared frame object 1800 to be able to scan a different portion of infrared frame object 1800 for heat signatures.

When all portions of infrared frame object 1800 have been processed for the detection of heat signatures, infrared frame object 1800 transitions to track state 1814. In track state 1814, tracking process 404 begins tracking all vehicles detected within infrared frame object 1800 that were confirmed for tracking. Further, tracking process 404 uses information from laser radar unit 250 to determine whether the detected vehicles are speeding. Once all detected vehicles within infrared frame object 1800 are tracked by tracking process 404, infrared frame object 1800 returns to start state 1802.

Figure 19:
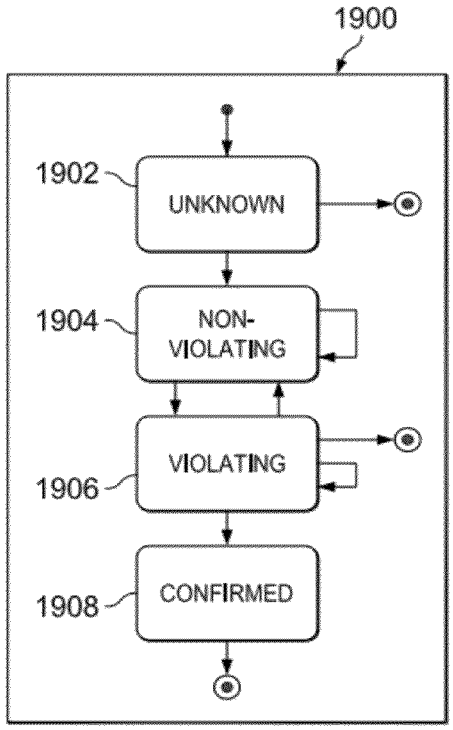
FIG. 19 is an illustration of a state diagram for a vehicle object in accordance with an advantageous embodiment.

With reference now to FIG. 19, an illustration of a state diagram for a vehicle object is depicted in accordance with an advantageous embodiment. In this illustrative example, vehicle object 1900 is an example of a vehicle object in vehicle class 1710 in FIG. 17. Vehicle object 1900 comprises data that is processed by detection process 400 in FIG. 4. Vehicle object 1900 contains data for a vehicle detected within infrared frame object 1800 in FIG. 18.

As depicted, vehicle object 1900 includes unknown state 1902, non-violating state 1904, violating state 1906, and confirmed state 1908. In these illustrative examples, when identification process 402 in detection process 400 detects a heat signature, vehicle object 1900 is initiated in unknown state 1902. Identification process 402 and/or tracking process 404 then determines whether the heat signature is for a vehicle.

If the heat signature is for a vehicle, vehicle object 1900 transitions to non-violating state 1904. If the heat signature is not for a vehicle, vehicle object 1900 is discarded. In these illustrative examples, an object may be discarded by being overwritten or deleted. In some examples, an object may be discarded by being stored but not referenced for future use.

In non-violating state 1904, detection process 400 uses information from laser radar unit 250 to determine whether the vehicle is travelling at a speed greater than a threshold. If the vehicle is not speeding, vehicle object 1900 remains in non-violating state 1904. If the vehicle is speeding, vehicle object 1900 enters violating state 1906. In these examples, vehicle object 1900 may transition back and forth between non-violating state 1904 and violating state 1906, depending on the speed of the vehicle.

In these illustrative examples, when vehicle object 1900 is in non-violating state 1904, vehicle object 1900 is stored in non-violating vehicle subclass 1714 in FIG. 17. When vehicle object 1900 is in violating state 1906, vehicle object 1900 is stored in violating vehicle subclass 1712 in FIG. 17.

When laser radar unit 250 collects a sufficient number of measurements to confirm that the vehicle is in violation, vehicle object 1900 transitions to confirmed state 1908. In confirmed state 1908, report generation process 408 is used to generate a report for the vehicle. Once a report for the vehicle is generated, vehicle object 1900 is terminated.

Figure 20:
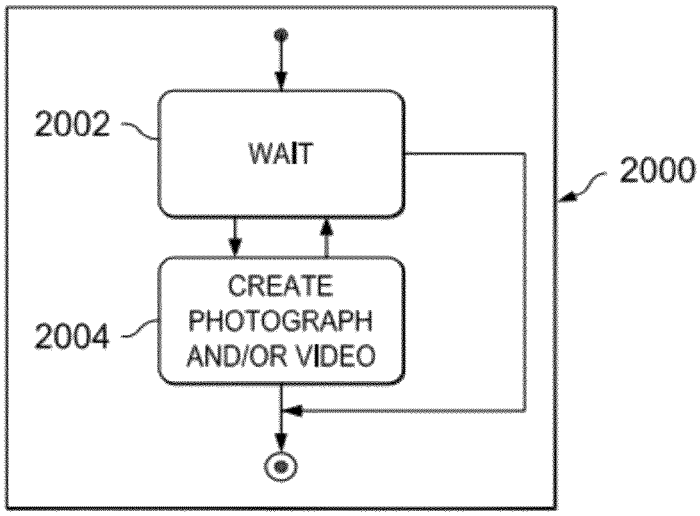
FIG. 20 is an illustration of a state diagram for a video camera object in accordance with an advantageous embodiment.

With reference now to FIG. 20, an illustration of a state diagram for a video camera object is depicted in accordance with an advantageous embodiment. In this illustrative example, video camera object 2000 is one example of a video camera object for video camera class 1708 in FIG. 17. Video camera object 2000 comprises data that is processed by detection process 400 in FIG. 4. Video camera object 2000 comprises data for visible light video camera 216 in FIG. 2.

As depicted, video camera object 2000 is initiated when the power for visible light video camera 216 is turned on. Video camera object 2000 is initiated in wait state 2002. In wait state 2002, visible light video camera 216 waits for instructions to generate a photograph and/or a video. These instructions may be received from, for example, data processing system 212 in FIG. 2.

When visible light video camera 216 receives instructions to generate a photograph, video camera object 2000 transitions to create photograph and/or video state 2004. In create photograph and/or video state 2004, visible light video camera 216 generates a photograph, such as photograph 432 in FIG. 4 and/or a video, such as video 433 in FIG. 4. In these examples, the photograph and/or video may be formed using a visible frame generated by visible light video camera 216.

Thereafter, video camera object 2000 may return to wait state 2002 or terminate. Video camera object 2000 may terminate when the power for visible light video camera 216 is turned off. Further, if the power for visible light video camera 216 is turned off during wait state 2002, video camera object 2000 also terminates. In other advantageous embodiments, video camera object 2000 may terminate when a particular condition for visible light video camera 216 has been met, a period of time has passed, or an event has occurred.

Figure 21:
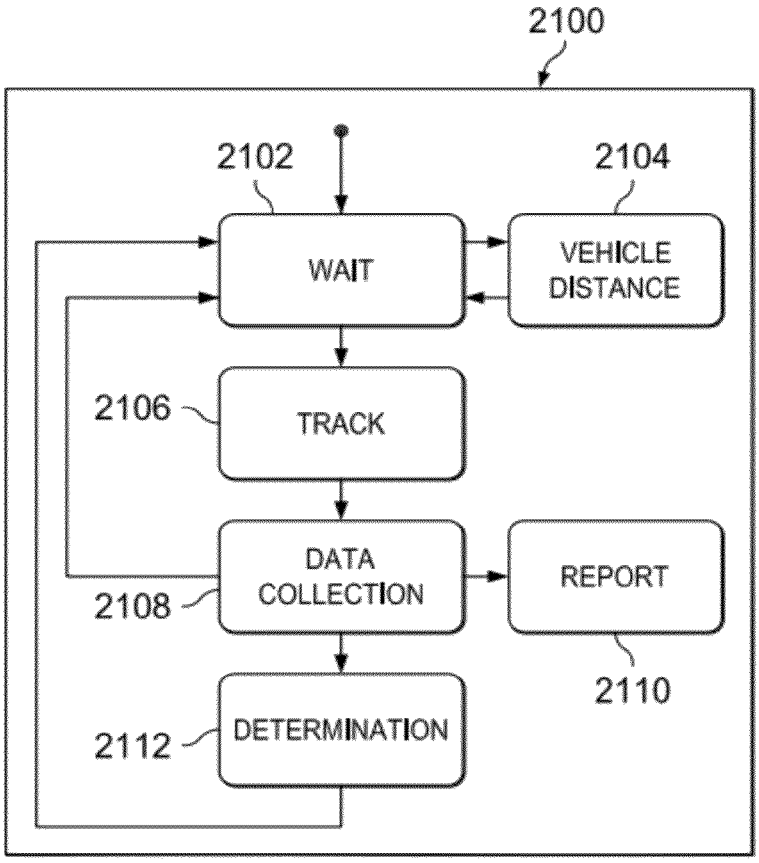
FIG. 21 is an illustration of a radar object in accordance with an advantageous embodiment.

With reference now to FIG. 21, an illustration of a radar object is depicted in accordance with an advantageous embodiment. In this illustrative example, radar object 2100 is an example of a radar object for radar class 1706 in FIG. 17. Radar object 2100 comprises data for laser radar unit 250 in FIG. 2. This data is processed by detection process 226 running in data processing system 212 in FIG. 2. In this depicted example, detection process 226 may have the configuration of detection process 400 in FIG. 4.

In this illustrative example, radar object 2100 has wait state 2102, vehicle distance state 2104, track state 2106, data collection state 2108, determination state 2112, and report state 2110. Radar object 2100 is initiated in wait state 2102 when the power for laser radar unit 250 is turned on.

While in wait state 2102, identification process 402 in detection process 400 may generate a command for laser radar unit 250. Laser radar unit 250 may be commanded to emit a laser beam in the direction of a vehicle on a road and to measure a distance to the vehicle relative to laser radar unit 250.

In response to receiving this command, radar object 2100 transitions to vehicle distance state 2104. In vehicle distance state 2104, laser radar unit 250 rotates in an azimuth angular direction and an elevation angular direction to emit the laser beam in the direction of the vehicle. Further, laser radar unit 250 calculates the distance from the laser radar unit 250 to the vehicle and sends this information to detection process 400. Radar object 2100 may then return to wait state 2102.

Identification process 402 and/or tracking process 404 may generate a command for laser radar unit 250 to perform speed measurements and to track a vehicle detected on a road. In response to this command, radar object 2100 may transition from wait state 2102 to track state 2106.

In track state 2106, laser radar unit 250 performs speed measurements for the vehicle. These measurements, along with other information, may be stored within vehicle object 1900 in FIG. 19. Once detection process 400 determines that tracking of the vehicle is completed, detection process 400 generates a command for laser radar unit 250 to stop tracking the vehicle. Thereafter, radar object 2100 transitions to data collection state 2108.

In data collection state 2108, detection process 400 determines whether sufficient data has been collected to generate a report using report generation process 408. In other words, if enough data has been collected to determine that a vehicle has violated a speed threshold, radar object 2100 transitions to report state 2110, and report generation process 408 generates a report for the vehicle based on information from laser radar unit 250.

If sufficient data has not been collected to generate a report, radar object 2100 may return to wait state 2102 or enter determination state 2112. In determination state 2112, detection process 400 uses information in radar object 2100 to determine whether the state of vehicle object 1900 should be changed. For example, if laser radar unit 250 collects information that identifies a vehicle as a target, vehicle object 1900 may transition from non-violating state 1904 to violating state 1906. Once detection process 400 makes any necessary state changes to vehicle object 1900, radar object 2100 returns to wait state 2102.

Figure 22:
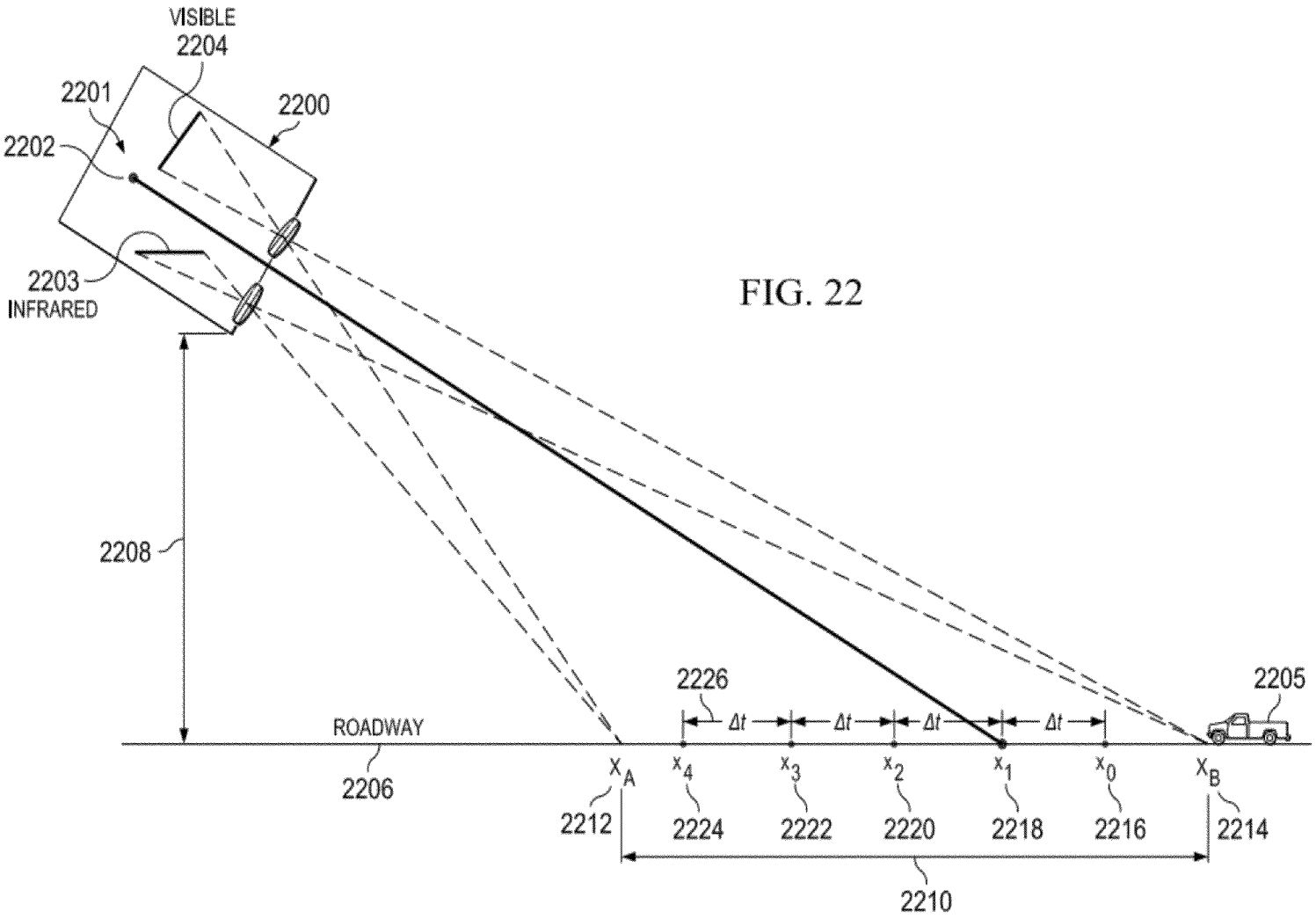
FIG. 22 is an illustration of a speed detection system in accordance with an advantageous embodiment.

With reference now to FIG. 22, an illustration of a speed detection system is depicted in accordance with an advantageous embodiment. In this illustrative example, speed detection system 2200 is an example of one implementation for speed detection system 202 in FIG. 2. As depicted, speed detection system 2200 includes camera system 2201 and laser radar unit 2202. Camera system 2201 may be one implementation for camera system 208 in FIG. 2, and laser radar unit 2202 may be one implementation for laser radar unit 250 in FIG. 2.

In this example, camera system 2200 includes infrared camera 2203 and visible light video camera 2204. In this illustrative example, camera system 2200 is positioned at height 2208 above road 2206. Both infrared camera 2203 and visible light video camera 2204 have field of view 2210 of road 2206 from point $X_A$ 2212 to point $X_B$ 2214.

In the different advantageous embodiments, infrared camera 2203 may be configured to provide information similar to the information provided by laser radar unit 2202. For example, infrared camera 2203 may be configured to provide estimate speed measurements for vehicle 2205 on road 2206. These estimate speed measurements may provide redundant speed measurements that are used to determine the accuracy and/or reliability of the speed measurements provided by laser radar unit 2202.

In some advantageous embodiments, laser radar unit 2202 may not provide speed measurements. For example, laser radar unit 2202 may not be capable of providing speed measurements during certain weather conditions, such as rain, fog, dust, and/or other weather conditions. When laser radar unit 2202 does not provide speed measurements, infrared camera 2203 may be used to provide estimate speed measurements for processing.

In this illustrative example, infrared camera 2203 may have an imaging sensor. This imaging sensor may take the form of a charge-coupled device (CCD) in this example. The imaging sensor may comprise an array of pixels. The sensitivity of the imaging sensor may depend on the angle of the imaging sensor with respect to road 2206. For example, the sensitivity of the imaging sensor in infrared camera 2203 may have a maximum value when the imaging sensor is parallel to road 2206. Further, the sensitivity of the imaging sensor relates to the ratio of a change in vertical pixels to a change in distance along road 2206.

The sensitivity of the imaging sensor in infrared camera 2203 may be identified using the following equation:

$$\frac{dp}{dx} = \frac{N_P}{X_A - X_B}. \tag{9}$$

In this equation, $N_p$, is the number of vertical pixels in the array of pixels for the imaging sensor in infrared camera 2203. Further, $X_A$ is the distance of point $X_A$ 2212 relative to speed detection system 2200, and $X_B$ is the distance of point $X_B$ 2214 relative to speed detection system 2200.

In this illustrative example, height 2208 is about 15 feet, $X_A$ is about 100 feet, and $X_B$ is about 500 feet. With field of view 2210, vertical pixel 0 of the array for the imaging sensor relates to point $X_B$ 2214 at about 500 feet, and vertical pixel r relates to point $X_A$ 2212 at about 100 feet. Of course, the different advantageous embodiments are applicable to other distances.

The vertical pixel location on the array for the imaging sensor may be identified as a function of the location of vehicle 2205 on road 2206 using the following equation:

$$p = N_P\left(1 + \frac{x - X_A}{X_A - X_B}\right), \tag{10}$$

or more specifically, $$p = N_P\left(1 - \frac{x - 100}{400}\right). \tag{11}$$

In these equations, p is the vertical pixel location, and x is the position of vehicle 2205 on road 2206 relative to speed detection system 2200.

The position of vehicle 2205 is identified by the following equation:

$$x = 500 - 400\left(\frac{p}{N_p}\right). \tag{12}$$

In this illustrative example, the position of vehicle 2205 may be measured to within substantially 1 pixel using the array of pixels for the imaging sensor in infrared camera 2203. For an array of 1024 by 1024 pixels, the error for this measurement may be identified as follows:

$$\mu_x = \frac{dx}{dp} = -\frac{400}{1024}. \tag{13}$$

In this equation, $\mu_x$ is the error for the measured vehicle position. The error for the measured vehicle position for vehicle 2205 is about 0.39 feet.

In this example, vehicle 2205 travels at a speed of about 100 feet per second. Speed detection system 2200 is configured to measure this speed using infrared camera 2203 about every second. The error for the distance traveled by vehicle 2205 is about 0.55 feet, and the error for the estimated speed of vehicle 2205 is about 0.55 percent. Thus, the error for the measured speed for vehicle 2205 traveling at about 100 feet per second beginning at point $X_B$ 2214 is about 0.55 feet per second. If speed detection system 2200 measures the speed of vehicle 2205 about four times per second, the error for the measured speed is reduced to about 0.28 percent.

Infrared camera 2203 is used to measure the position of vehicle 2205 as vehicle 2205 travels on road 2206. For example, the position of vehicle 2205 is measured at points 2216, 2218, 2220, 2222, and 2224 over time. An estimate of the speed of vehicle 2205 may be identified by the following equation:

$$V = \left(\frac{-x0 + 8x1 - 8x3 + x4}{12\Delta t}\right). \tag{14}$$

In equation 14, V is the estimated speed for vehicle 2205, x0 is the position of point 2216, x1 is the position of point 2218, x2 is the position of point 2220, x3 is the position of point 2222, and x4 is the position of point 2224. Further, as depicted, Δt is the period of time it takes vehicle 2205 to reach each of points 2216, 2218, 2220, 2222, and 2224.

The estimated average speed of vehicle 2205 while accelerating based on the range of physically possible speed measurements may be identified as follows:

$$\bar{v} = \frac{v_0 + \sqrt{v_0^2 + 2a_{max}(X_B - X_A)}}{2}$$

In this equation, $\bar{v}$ is the estimated average speed of vehicle 2205, $v_0$ is an initial speed of vehicle 2205 at point $X_B$ 2214, and $a_{max}$ is a maximum acceleration of vehicle 2205.

In these illustrative examples, the speed of vehicle 2205 as measured by laser radar unit 2202 is desired to be within a tolerance of about five percent of the estimated average speed of vehicle 2205. This tolerance ensures a desired level of accuracy for the speed measurements provided by laser radar unit 2202.

In these advantageous embodiments, speed detection system 2200 may implement a detection process, such as detection process 400 in FIG. 4. Report generation process 408 in detection process 400 may generate report 414 for vehicle 2205 when speed detection system 2200 measures a speed of vehicle 2205 as greater than a selected threshold. This report may take the form of a ticket in this example. The report is generated when at least three conditions are met.

The first condition is that for the speed measurements provided by laser radar unit 2202, the lowest measured speed is greater than a selected threshold. The second condition is that the speed measurements provided by laser radar unit 2202 are within a tolerance of about five percent of the estimated average speed measured using infrared camera 2203. The third condition is that the estimated average speed measured using infrared camera 2203 is within a tolerance of about five percent of the speed measurements provided by laser radar unit 2202. When at least three conditions are met, report generation process 408 generates a ticket for vehicle 2205.

In some advantageous embodiments, report generation process 408 may not generate a ticket for vehicle 2205 when at least two conditions are met. The first condition is that vehicle 2205 is accelerating more than about three feet per second squared. The second condition is that speed measurements were provided by laser radar unit 2202 in error. For example, the second condition is met when a laser beam emitted by laser radar unit 2202 hits a moving part of vehicle 2205 or an object other than vehicle 2205.

In these illustrative examples, the thresholds and/or conditions described above may be modified depending on the particular implementation. For example, the thresholds and/or conditions may be modified, based on a desired level of accuracy and a desired reliability of the speed measurements and/or report.

Figure 23:
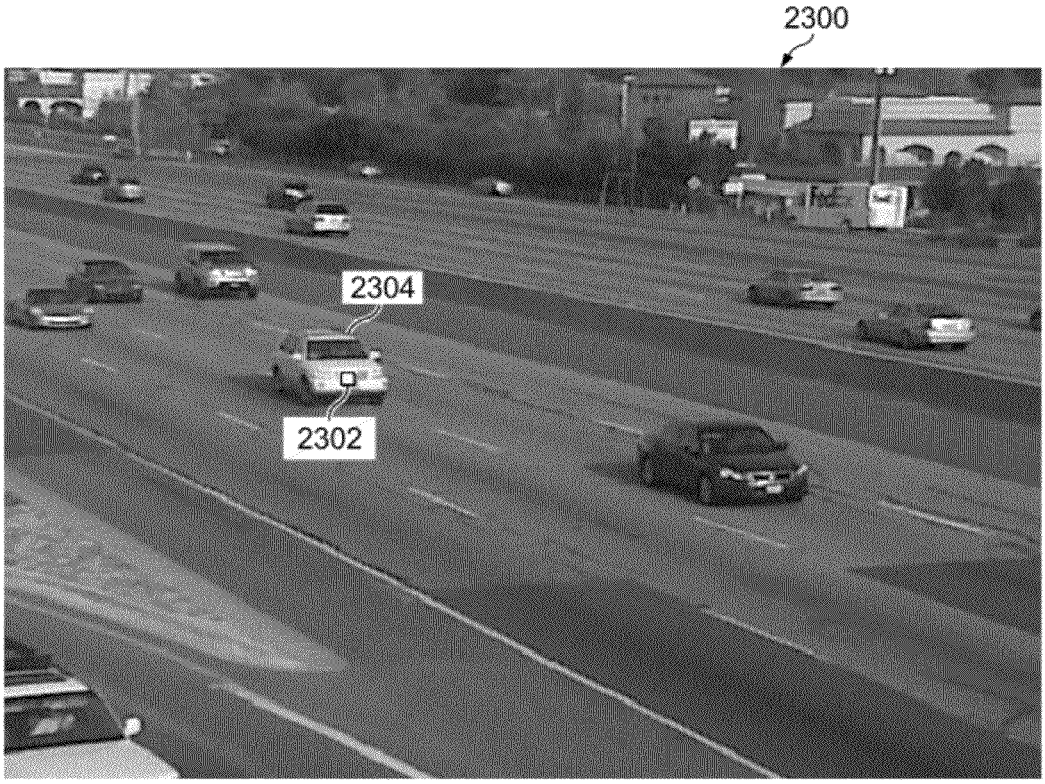
FIG. 23 is an illustration of a photograph in accordance with an advantageous embodiment.

With reference now to FIG. 23, an illustration of a photograph is depicted in accordance with an advantageous embodiment. In this illustrative example, photograph 2300 is an example of one of number of photographs 254 that may be generated using detection process 226 in FIG. 2. As depicted, photograph 2300 is generated using a visible frame generated by visible light video camera 216 in FIG. 2. Pixel 2302 is illuminated to indicate the location on vehicle 2304 at which the laser beam hit vehicle 2304 to make speed measurements for vehicle 2304. In this illustrative example, vehicle 2304 is a vehicle travelling at a speed greater than a selected threshold.

Figure 24:
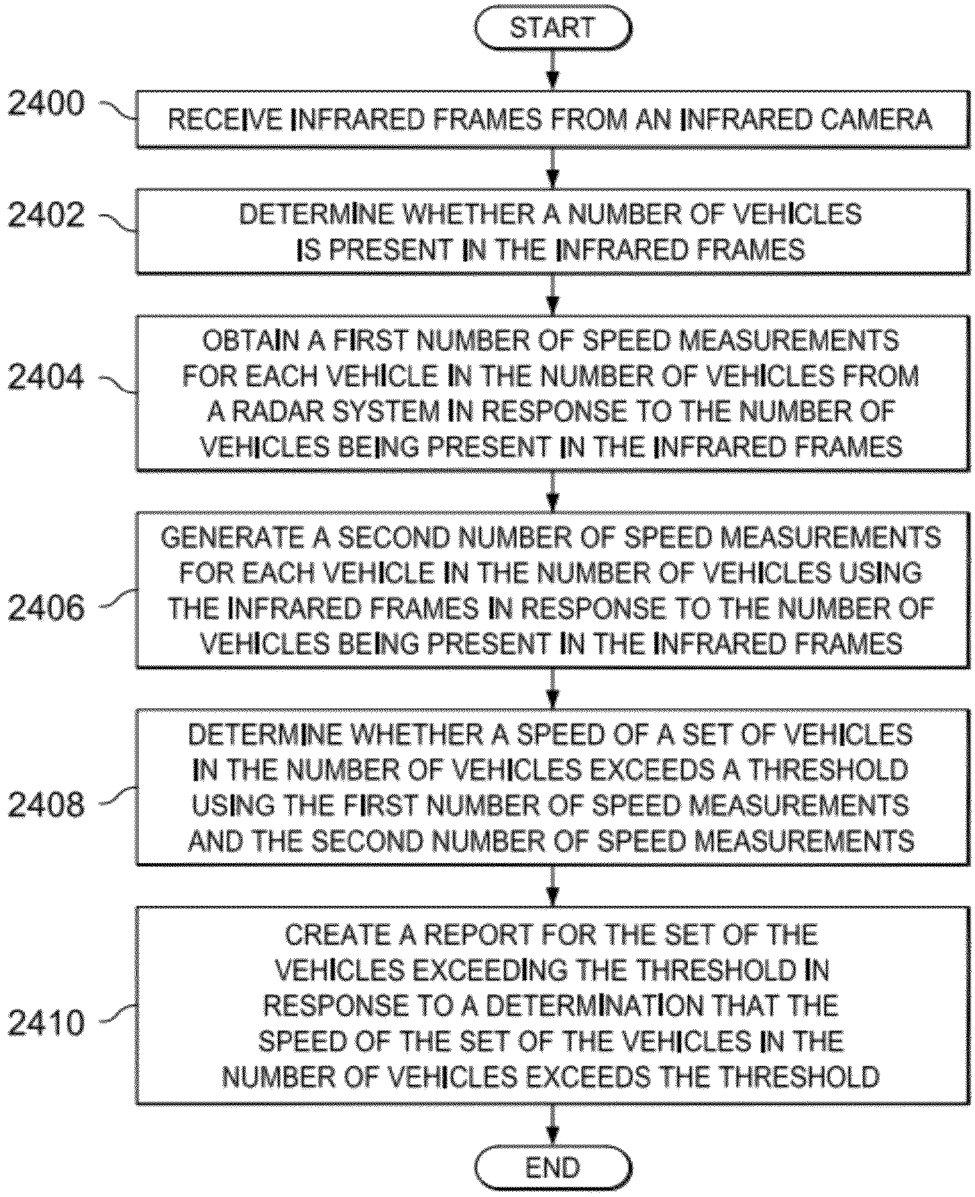
FIG. 24 is an illustration of a flowchart of a method for identifying vehicles exceeding a speed limit in accordance with an advantageous embodiment.

With reference now to FIG. 24, a flowchart of a method for identifying vehicles exceeding a speed limit is depicted in accordance with an advantageous embodiment. The process illustrated in FIG. 24 may be implemented using a speed detection system, such as speed detection system 202 in speed detection environment 200 in FIG. 2.

The process begins by receiving infrared frames from an infrared camera (operation 2400). The process then determines whether a number of vehicles are present in the infrared frames (operation 2402). The process in operation 2402 may be implemented using identification process 402 in detection process 400 in FIG. 4.

In response to the number of vehicles being present in the infrared frames, the process obtains a first number of speed measurements for each vehicle in the number of vehicles from a radar system (operation 2404). The radar system may be implemented using radar system 210 in FIG. 2. Further, the radar system may include a laser radar unit, such as laser radar unit 250 in FIG. 2. The laser radar unit may be implemented using the configuration of laser radar unit 500 in FIG. 5.

Thereafter, the process generates a second number of speed measurements for each vehicle in the number of vehicles using the infrared frames in response to the number of vehicles being present in the infrared frames (operation 2406). The processes in operations 2404 and 2406 may be implemented using tracking process 404 in FIG. 4.

The process determines whether a speed of a set of vehicles in the number of vehicles exceeds a threshold using the first number of speed measurements and the second number of speed measurements (operation 2408). In response to a determination that the speed of the set of the vehicles in the number of vehicles exceeds the threshold, the process creates a report for the set of the vehicles exceeding the threshold (operation 2410). The process in operation 2410 may be implemented using report generation process 408 in FIG. 4. For example, report generation process 408 may generate report 414 for each of the set of vehicles exceeding the threshold.

Thus, the different advantageous embodiments provide a method and apparatus for identifying vehicles exceeding a speed limit using a speed detection system. In the different advantageous embodiments, infrared frames are received from an infrared camera. A determination is made as to whether a number of vehicles are present in the infrared frames. In response to the number of vehicles being present, a number of speed measurements are made for each vehicle in the number of vehicles using a radar system. If the speed of a set of vehicles in the number of vehicles exceeds the speed limit, a report is created for the set of vehicles.

The speed detection system allows the number of speed measurements to be made for the number of vehicles over a period of time. In this manner, the number of vehicles may be tracked as the number of vehicles travel over a road over time. A vehicle traveling at a speed measurement equal to or less than the speed limit at one point in time may be identified as traveling at a speed exceeding the speed limit at a different point in time. The driver of the vehicle may be prosecuted for violation of the speed limit at the different point in time.

The report may be used by law enforcement officials to stop a vehicle upon generation of the report. For example, a report may be generated for a vehicle in violation of a speed limit in real time. The report may be sent to a law enforcement official at a location near to the speed detection system substantially immediately upon generation of the report. The law enforcement official may identify a license plate for the vehicle from the report and may pursue the vehicle to stop the vehicle for violation of the speed limit.

The report also may be used by law enforcement officials to prosecute the drivers of the set of vehicles exceeding the speed limit at a later point in time. In this manner, a number of reports may be generated for the set of vehicles traveling on a road in violation of the speed limit such that law enforcement officials may prosecute drivers of the number of vehicles violating the speed limit at the convenience of the law enforcement officials and/or law enforcement agency.

The different advantageous embodiments can take the form of an entirely hardware embodiment, an entirely software embodiment, or an embodiment containing both hardware and software elements. Some embodiments are implemented in software, which includes, but is not limited to, forms such as, for example, firmware, resident software, and microcode.

Furthermore, the different embodiments can take the form of a computer program product accessible from a computer-usable or computer-readable medium providing program code for use by or in connection with a computer or any device or system that executes instructions. For the purposes of this disclosure, a computer-usable or computer-readable medium can generally be any tangible apparatus that can contain, store, communicate, propagate, or transport the program for use by or in connection with the instruction execution system, apparatus, or device.

The computer-usable or computer-readable medium can be, for example, without limitation, an electronic, magnetic, optical, electromagnetic, infrared, or semiconductor system, or a propagation medium. Non-limiting examples of a computer-readable medium include a semiconductor or solid state memory, magnetic tape, a removable computer diskette, a random access memory (RAM), a read-only memory (ROM), a rigid magnetic disk, and an optical disk. Optical disks may include compact disk-read only memory (CD-ROM), compact disk-read/write (CD-R/W), and DVD.

Further, a computer-usable or computer-readable medium may contain or store a computer-readable or usable program code such that when the computer-readable or usable program code is executed on a computer, the execution of this computer-readable or usable program code causes the computer to transmit another computer-readable or usable program code over a communications link. This communications link may use a medium that is, for example, without limitation, physical or wireless.

A data processing system suitable for storing and/or executing computer-readable or computer-usable program code will include one or more processors coupled directly or indirectly to memory elements through a communications fabric, such as a system bus. The memory elements may include local memory employed during actual execution of the program code, bulk storage, and cache memories which provide temporary storage of at least some computer-readable or computer-usable program code to reduce the number of times code may be retrieved from bulk storage during execution of the code.

Input/output or I/O devices can be coupled to the system either directly or through intervening I/O controllers. These devices may include, for example, without limitation, keyboards, touch screen displays, and pointing devices. Different communications adapters may also be coupled to the system to enable the data processing system to become coupled to other data processing systems or remote printers or storage devices through intervening private or public networks. Non-limiting examples are modems and network adapters and are just a few of the currently available types of communications adapters.

The description of the different advantageous embodiments has been presented for purposes of illustration and description, and it is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A method for detecting moving vehicles, the method comprising:

determining whether a number of vehicles are present in a video data stream received from a camera system, wherein the video data stream comprises an infrared video data stream, and wherein determining whether the number of vehicles are present further comprises;

selecting a frame in the infrared video data stream; and determining whether a number of heat signatures having a selected level of heat for a vehicle is present in the frame to determine whether the number of vehicles is present;

responsive to the number of vehicles being present, obtaining a number of speed measurements for each vehicle in the number of vehicles from a radar system;

determining whether a speed of a set of vehicles in the number of vehicles exceeds a threshold; and responsive to a determination that the speed of the set of vehicles exceeds the threshold, creating a report for the set of the vehicles exceeding the threshold.

2. The method of claim 1 further comprising:

sending the report to an entity.

3. The method of claim 1, wherein the step of determining whether the number heat signatures having the selected level of heat for the vehicle is present in the frame to determine whether the number of vehicles is present comprises:

moving a window within the frame and determining whether the number heat signatures having the selected level of heat for the vehicle is present in the frame to determine whether the number of vehicles is present in an area within the window.

4. The method of claim 1, wherein the step of determining whether the speed of the set of vehicles in the number of vehicles exceeds the threshold comprises:

determining whether the speed of any of the number of vehicles exceeds a value more than a selected number of times in the number of speed measurements for the each vehicle in the number of vehicles.

5. The method of claim 1, wherein the step of creating the report for the set of the vehicles exceeding the threshold comprises:

placing a photograph of the each vehicle in the set of vehicles in the report; and associating the number of speed measurements with the each vehicle in the set of vehicles in the report.

6. The method of claim 5 further comprising:

receiving the photograph containing a vehicle for the each vehicle in the number of vehicles from the camera system, wherein the photograph is formed using a frame from a visible light video camera in the camera system.

7. The method of claim 5 further comprising:

identifying a license plate of the each vehicle in the set of vehicles using the photograph to form an identification for the each vehicle in the set of vehicles; and placing the identification in the report.

8. The method of claim 1, wherein the step of creating the report for the set of vehicles exceeding the threshold comprises:

placing a video of the each vehicle in the set of vehicles in the report; and associating the number of speed measurements with the each vehicle in the set of vehicles in the report.

9. The method of claim 8 further comprising:

receiving the video of the each vehicle in the set of vehicles from the camera system.

10. The method of claim 1, wherein the camera system comprises an infrared camera and a visible light video camera.

11. The method of claim 1, wherein the radar system comprises a laser radar unit.

12. The method of claim 1, wherein the report includes an average speed of the number of vehicles.

13. A method of identifying vehicles exceeding a speed limit, the method comprising:

receiving infrared frames from an infrared camera;

determining whether a number of vehicles are present in the infrared frames, wherein determining whether the number of vehicles are present further comprises;

selecting a frame in the infrared frames; and determining whether a number of heat signatures having a selected level of heat for a vehicle is present in the frame to determine whether the number of vehicles are present;

responsive to the number of vehicles being present in the infrared frames, obtaining a first number of speed measurements for each vehicle in the number of vehicles from a radar system;

responsive to the number of vehicles being present in the infrared frames, generating a second number of speed measurements for each vehicle in the number of vehicles using the infrared frames;

determining whether a speed of a set of vehicles in the number of vehicles exceeds a threshold using the first number of speed measurements and the second number of speed measurements; and responsive to a determination that the speed of the set of vehicles in the number of vehicles exceeds the threshold, creating a report for the set of the vehicles exceeding the threshold.

14. The method of claim 13, wherein the step of creating the report for the set of vehicles exceeding the threshold comprises:

placing a photograph of the each vehicle in the set of vehicles in the report;

placing a video of the each vehicle in the set of vehicles in the report; and associating the first number of speed measurements and the second number of speed measurements with the each vehicle in the set of vehicles in the report.

15. The method of claim 13 further comprising:

adjusting the first number of speed measurements using offset information for the radar system.

16. The method of claim 15, wherein the offset information comprises a first angle for an elevation of the radar system relative to the each vehicle, a second angle for an azimuth of the radar system relative to the vehicle, and a distance from the radar system to the vehicle.

17. The method of claim 13, wherein the step of determining whether the number heat signatures having the selected level of heat for the vehicle is present in the frame to determine whether the number of vehicles is present comprises:

moving a window within the frame and determining whether the number heat signatures having the selected level of heat for the vehicle is present in the frame to determine whether the number of vehicles is present in an area within the window.

18. An apparatus comprising:

a camera system;

a radar system; and a processor unit configured to determine whether a number of vehicles are present in a video data stream received from the camera system, wherein the camera system includes at least an infrared camera, wherein the processor is configured to determine the number of vehicles present by selecting a frame in a number of infrared frames and determining whether a number of heat signatures having a selected level of heat for each vehicle is present in the frame to determine whether the number of vehicles is present, and wherein the processor unit is further configured to obtain a number of speed measurements for the each vehicle in the number of vehicles from the radar system in response to the number of vehicles being present; determine whether a speed of a set of vehicles in the number of vehicles exceeds a threshold; and create a report for the set of vehicles exceeding the threshold in response to a determination that the speed of the set of vehicles in the number of vehicles exceeds the threshold.

19. The apparatus of claim 18, wherein the radar system comprises:

a laser radar unit.

20. The apparatus of claim 19, wherein the processor unit is configured to change a direction of a laser beam generated by the laser radar unit to illuminate the each vehicle within the set of vehicles to generate the first number of speed measurements and the second number of speed measurements for the each vehicle.

21. The apparatus of claim 18, wherein the processor unit is configured to obtain a first number of speed measurements for the each vehicle in the number of vehicles from the radar system in response to the number of vehicles being present in the infrared frames; generate a second number of speed measurements for the each vehicle in the number of vehicles using the infrared frames in response to the number of vehicles being present in the infrared frames; and determine whether the speed of the set of vehicles in the number of vehicles exceeds the threshold using the first number of speed measurements and the second number of speed measurements.

22. The apparatus of claim 21, wherein the camera system, the radar system, and the processor unit form a speed detection system and wherein the speed detection system is configured to be mounted at an offset from a road on which the number of vehicles is present.

23. The apparatus of claim 22, wherein the processor unit is configured to adjust the first number of speed measurements using offset information from the radar system.

24. The apparatus of claim 23, wherein the offset information comprises a first angle for an elevation of the radar system relative to the each vehicle, a second angle for an azimuth of the radar system relative to the each vehicle, and a distance from the radar system to the vehicle.

25. The apparatus of claim 18 wherein, in determining whether the number heat signatures having the selected level of heat for the vehicle is present in the frame to determine whether the number of vehicles is present, the processor is further configured to move a window within the frame and determine whether the number heat signatures having the selected level of heat for the vehicle is present in the frame to determine whether the number of vehicles is present in an area within the window.

* * * * *